US006697035B2

(12) United States Patent
Sugahara et al.

(10) Patent No.: US 6,697,035 B2
(45) Date of Patent: Feb. 24, 2004

(54) DISPLAY DEVICE AND MOVING-FILM DISPLAY DEVICE

(75) Inventors: Atsushi Sugahara, Yokohama (JP); Goh Itoh, Yokohama (JP); Richard Lang, Tokyo (JP); Haruhiko Okumura, Fujisawa (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 345 days.

(21) Appl. No.: 09/804,238

(22) Filed: Mar. 13, 2001

(65) Prior Publication Data

US 2001/0043167 A1 Nov. 22, 2001

(30) Foreign Application Priority Data

Mar. 30, 2000 (JP) ..... 2000-094567
Mar. 30, 2000 (JP) ..... 2000-094875

(51) Int. Cl.[7] ..... G09G 3/34
(52) U.S. Cl. ..... 345/85; 345/31
(58) Field of Search ..... 340/815.83; 345/85, 345/31

(56) References Cited

U.S. PATENT DOCUMENTS 4,194,189 A * 3/1980 Lewiner et al. ..... 340/815.83
5,943,033 A 8/1999 Sugahara et al. ..... 345/85
6,130,656 A 10/2000 Sugahara ..... 345/85

FOREIGN PATENT DOCUMENTS

| | | |
|---|---|---|
| JP | 60-170897 | 9/1985 |
| JP | 8-271933 | 10/1996 |
| JP | 9-43575 | 2/1997 |
| JP | 11-95693 | 4/1999 |

* cited by examiner

*Primary Examiner*—Steven Saras
*Assistant Examiner*—Uchendu O. Anyaso
(74) *Attorney, Agent, or Firm*—Oblon, Spivak, McClelland, Maier & Neustadt, P.C.

(57) ABSTRACT

In a moving-film display device, each pixel includes a moving film electrode capable of bending and a counter electrode. The display color of each pixel is determined when the moving film electrode bends by a potential difference between the moving film electrode and the counter electrode. The moving film electrode is connected to a signal line via a TFT. The TFT is turned on/off by an address line. A controller keeps the TFT ON until the potential of the moving film electrode becomes substantially equal to a signal potential, and turns off the TFT before the moving film electrode comes closest to the counter electrode.

28 Claims, 17 Drawing Sheets

DISPLAY DEVICE AND MOVING-FILM DISPLAY DEVICE

CROSS-REFERENCE TO RELATED APPLICATIONS

This application is based upon and claims the benefit of priority from the prior Japanese Patent Applications No. 2000-094567, filed Mar. 30, 2000; and No. 2000-094875, filed Mar. 30, 2000, the entire contents of both of which are incorporated herein by reference.

BACKGROUND OF THE INVENTION

The present invention relates to a display device and, more particularly, to a moving-film display device.

Recently, low power consumption is required in large display devices or in portable display devices. One display device which accomplishes this low power consumption is a moving-film display device which drives a moving film electrode by electrostatic force. Jpn. Pat. Appln. KOKAI Publication Nos. 8-271933 and 11-95693 disclosed moving-film display devices of this type.

As shown in FIG. 15, a moving-film display device has a pixel matrix, i.e., an array, defined by rows and columns of a plurality of pixels. As shown in FIG. 15, each pixel has a moving film electrode 11, a fixed portion 12, and a counter electrode 13. The moving film electrode 11 and the fixed portion 12 are connected to a signal line 41, and the counter electrode 13 is connected to an address line 42. The upper end portions of the moving film electrode 11 and the fixed portion 12 are colored in first and second different colors, e.g., black and white. The display color of each pixel is determined in accordance with whether or not the moving film electrode 11 bends by electrostatic force on the basis of a potential difference between the moving film electrode 11 and the counter electrode 13 (a potential difference between a signal potential and a counter potential).

As will be described later, the material of the moving film electrode 11 is so selected that the electrode 11 has hysteresis characteristics. Therefore, the moving film electrode 11 has stable states at positions where it is attracted to the fixed portion 12 and where it is attracted to the counter electrode 13, i.e., the moving film electrode 11 has bistability similarly to, e.g., a ferroelectric liquid crystal. This allows each pixel to display an image by driving the address line 42 for applying a voltage to the counter electrode 13 and driving the signal line 41 for applying a voltage to the moving film electrode 11 and the fixed portion 12.

A moving-film display device can also be driven by using a latch circuit 51 as shown in FIG. 16. That is, this latch circuit 51 with memory properties has first and second switches 52 and 53 which can be turned on and off. When the first switch 52 is turned on, a moving film electrode 11 and a fixed portion 12 are given a potential from a constant-potential line 54 having a predetermined potential. When the second switch 53 is turned on, the moving film electrode 11 and the fixed portion 12 are given a potential from a ground line 55. The constant-potential line 54 supplies a potential different from that of the ground line 55. Since a counter electrode 13 is given a potential from the ground, the moving film electrode 11 can be selectively bent by driving the latch circuit 51 of a corresponding pixel, thereby displaying an image.

Unfortunately, these conventional moving-film display devices have the following problems.

First, in the driving method using the simple matrix circuit shown in FIG. 15, when one pixel is selected and applied with a signal potential, the moving film electrode must bend to come in contact with the counter electrode or the bent moving film electrode must come in contact with the fixed portion before the next pixel is driven. For example, if a signal potential is applied to a second pixel connected to the same signal line as a first pixel before the moving film electrode of the first pixel finishes moving, this signal potential for the second pixel may cause the first pixel to behave in a way different from that obtained by the signal for the first pixel. After the moving film electrode comes in contact with either electrode, the signal is stably held because the moving film electrode has hysteresis characteristics. Accordingly, the drive time of one pixel must be longer than at least the time required to move the moving film electrode. This makes it impossible to realize a high-resolution display device or a display of motion images by shortening the time for driving one pixel.

The driving method using the latch circuit as shown in FIG. 16 requires one storage circuit for each pixel. Since this increases the number of constituent elements, the method cannot be realized at low cost. Additionally, since the structure is complicated by the use of one storage circuit for each pixel, fine pixels are difficult to form. Therefore, no small high-resolution display device can be realized.

A method of performing a gradation display in the moving-film display device will be described next. The basic operation of the moving-film display device is a binary display scheme having a state in which the moving film electrode bends and a state in which it does not. Hence, gradation display methods proposed so far are the following two methods.

The first method is a dither method which performs dot area modulation by forming one pixel from a plurality of elements, assuming that a set of the moving film electrode 11, the fixed portion 12, and the counter electrode 13 is one element. That is, one pixel is formed by n elements, and (n+1) gradation levels are displayed by turning on some of these elements.

The second method is a frame rate control (FRC) method which switches a display state and non-display state by dividing a time, during which an image is displayed once by supplying a signal to one pixel, into a plurality of units. That is, the time during which an image is displayed once by supplying a signal to one pixel is equally divided into n portions, and (n+1) gradation levels are displayed by turning on some of these portions.

Unfortunately, these gradation display methods have several problems.

In the dither method, one pixel is formed by a plurality of elements described above. Since, therefore, the size of one pixel cannot be unlimitedly decreased, a high-resolution display device is difficult to form. Also, even if small elements can be formed, the number of lines such as signal lines increases, and this makes the formation difficult.

In the FRC method, the time during which an image is displayed once by supplying a signal to one pixel is equally divided into n portions. Since this shortens the switching time, the signal frequency rises to make high-resolution images difficult to display. Additionally, when a large display device is formed, the wiring length increases, and this increases the possibility of occurrence of signal delays. High signal frequency of the FRC method is further problematic because the number of pixels also increases.

BRIEF SUMMARY OF THE INVENTION

It is an object of the present invention to provide a moving-film display device having high resolution and capable of displaying motion images.

It is another object of the present invention to provide a display device capable of performing a gradation display even when high-resolution images are to be displayed or even when the display device is large.

According to a first aspect of the present invention, there is provided a moving-film display device comprising:

a pixel matrix defined by rows and columns of a plurality of pixels, each of the pixels comprising first and second electrodes, one of the first and second electrodes being a moving film electrode capable of bending, at least its end portion having a colored portion, the other of the first and second electrodes being a counter electrode which opposes the moving film electrode, and a switch connected to the first electrode;

a plurality of signal lines, each connected to the switches of pixels arranged in a raw in order to supply an image signal, for driving the first electrodes;

a signal line driver configured to selectively supply the image signal to the signal lines;

a plurality of counter potential lines, each connected to the second electrodes of pixels arranged in a column in order to give a counter potential to the second electrodes;

a plurality of address lines, each of address lines supplying a control signal to the switches for selecting the pixels; and a controller configured to control the signal lines, the counter potential lines, and the switches;

wherein a display color of each pixel is determined when the moving film electrode bends by a potential difference between the moving film electrode and the counter electrode.

According to a second aspect of the present invention, there is provided a moving-film display device comprising a pixel matrix defined by rows and columns of a plurality of pixels disposed on an insulating substrate, wherein, in each of the pixels, the device comprises:

a semiconductor switch disposed on the substrate and electrically connected to a signal line;

an intermediate conductor plate disposed on the substrate via a first insulating layer and electrically connected to the switch;

an upper conductor plate disposed on the intermediate conductor plate via a second insulating layer, the intermediate conductor plate and the upper conductor plate being electrically coupled with each other; and a pair of electrodes including first and second electrodes which oppose each other while standing on the second insulating layer, the first electrode being electrically connected to the upper conductor plate, the second electrode being given a counter potential, one of the first and second electrodes being a moving film electrode which has a colored portion in an upper end portion and can bend, the other being a counter electrode which opposes the moving film electrode, and a display color of each pixel being determined when the moving film electrode bends by a potential difference between the moving film electrode and the counter electrode.

According to a third aspect of the present invention, there is provided a display device comprising:

a pixel matrix defined by rows and columns of a plurality of pixels, each of the pixels comprising a pair of electrodes including first and second electrodes opposing each other, and a colored portion which determines a display color of the pixel by changing an exposed state thereof in accordance with a potential difference between the pair of electrodes;

a plurality of signal lines which run along the pixels to give the first electrode a signal potential as an image signal;

a counter potential line disposed to give a counter potential to the second electrode;

a capacitor so disposed in each of the pixels as to connect a node between the signal line and the first electrode to a constant-potential portion different from the second electrode, in order to hold the signal potential given from the signal line;

a bypass formed in each of the pixels and including a resistor connected to the node in parallel with the capacitor in order to release electric charge from the capacitor;

a signal line driver configured to selectively supply the image signal to the signal lines; and a controller configured to control the signal line driver, the controller applying a gradation display potential different from one pixel to another as the signal potential in order to perform a gradation display on the basis of an exposure/non-exposure time of the colored portion.

DETAILED DESCRIPTION OF THE INVENTION

Figure 1:
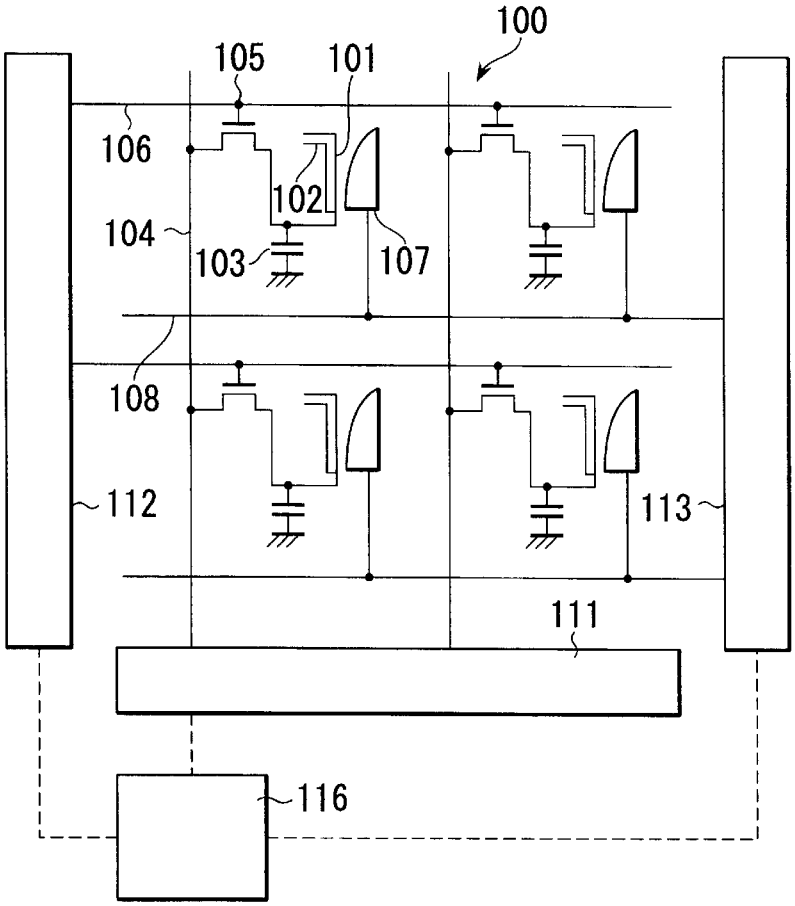
FIG. 1 is a circuit diagram showing a moving-film display device according to the first embodiment of the present invention.

Embodiments of the present invention will be described below with reference to the accompanying drawings. In the following explanation, the same reference numerals denote parts having substantially the same functions and arrangements, and the same description will be repeated only where necessary.

(First Embodiment)

FIG. 1 is a circuit diagram showing a moving-film display device according to the first embodiment of the present invention. As shown in FIG. 1, this moving-film display device has a pixel matrix, i.e., an array 100 defined by rows and columns of a plurality of pixels. Each pixel has a moving film electrode 101, a fixed portion 102, and a counter electrode 107. The upper end portions of the moving film electrode 101 and the fixed portion 102 are colored in first and second different colors, e.g., black and white. The display color of each pixel is determined in accordance with whether or not the moving film electrode 101 bends by electrostatic force on the basis of a potential difference between a pair of electrodes including the moving film electrode 101 and the counter electrode 107.

Figure 12A:
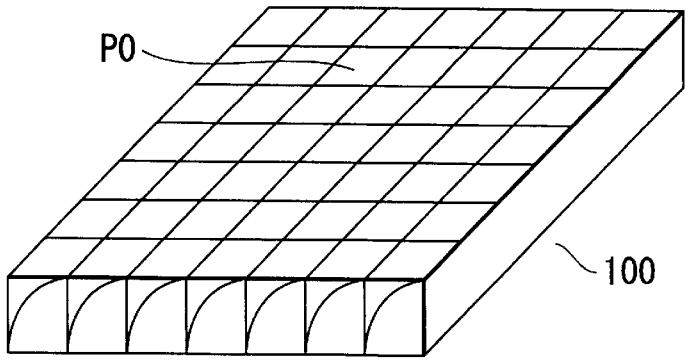
FIG. 12A is a view showing pixels formed into the shape of a matrix, i.e., an array of the moving-film display device.
Figure 12B:
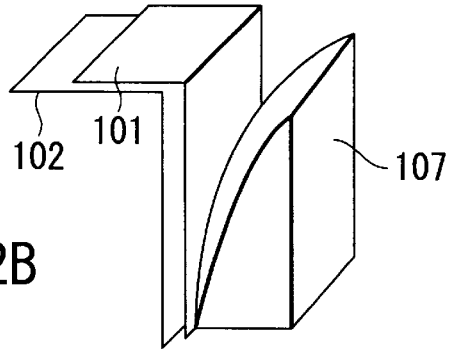
FIG. 12B is a view showing one of these pixels.
Figure 13:
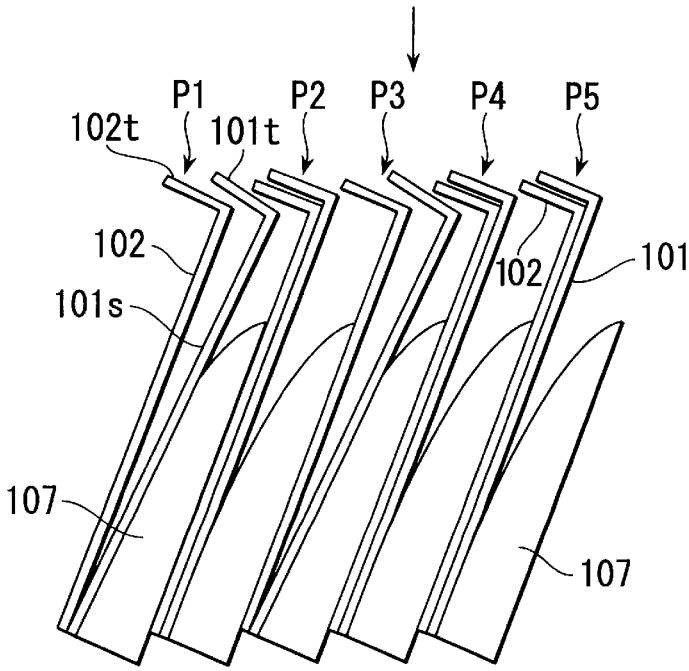
FIG. 13 is a side view showing pixels in one row of the moving-film display device.

FIG. 12A is a perspective view showing the pixel matrix 100 of the moving-film display device. FIG. 12B is an enlarged perspective view showing one pixel P0. FIG. 13 shows pixels in one row of the pixel matrix 100 of the moving-film display device. The operation of this moving-film display device will be explained below with reference to FIG. 13.

When a potential different is present between the moving film electrode 101 and the counter electrode 107, electrostatic force is generated between them. As indicated by pixels P1 and P3, a stem 101*s* of the flexible moving film electrode 101 is attracted to the counter electrode 107 and bends. When the moving film electrode 101 thus bends, an upper end portion 102*t* of the fixed portion 102 is exposed. When viewed in the direction of an arrow, therefore, the color (white) of this upper end portion 102*t* of the fixed portion 102 is displayed. In this state, an upper end portion 101*t* of the moving film electrode 101 is hidden under the fixed portion 102 of the adjacent pixel. Hence, the color (black) of this upper end portion 101*t* of the moving film electrode 101 is not displayed.

On the other hand, when there is no potential difference between the moving film electrode 101 and the counter electrode 107, no electrostatic force is generated between them. Hence, as indicated by pixels P2, P4, and P5, the stem 101*s* of the moving film electrode 101 does not bend toward the counter electrode 107. In this state, the upper end portion 101*t* of the moving film electrode 101 covers the upper end portion 102*t* of the fixed portion 102. When viewed in the direction of the arrow, therefore, the color (black) of the upper end portion 101*t* of the moving film electrode 101 is displayed.

Motion images can be displayed by sequentially driving the moving film electrode 101 on the basis of the potential difference between this moving film electrode 101 and the counter electrode 107 in all pixels as described above.

Figure 14:
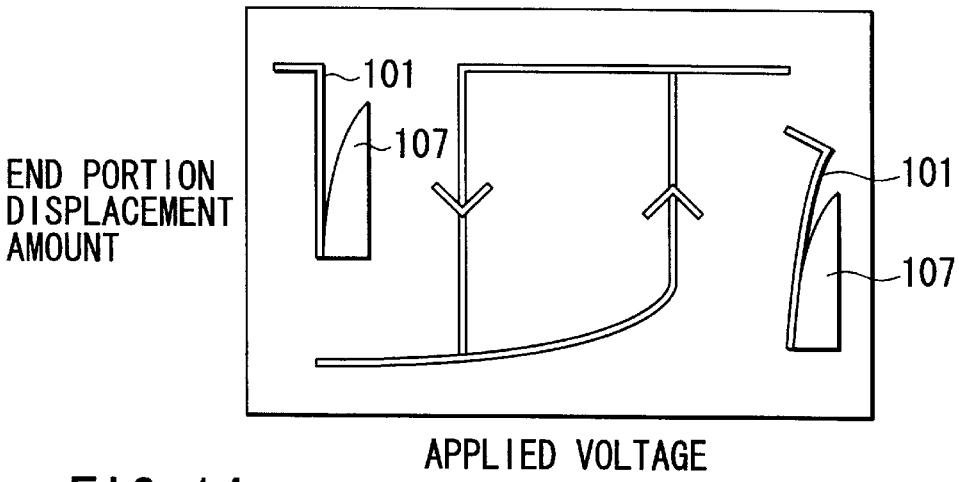
FIG. 14 is a view showing the displacement amount of the distal end portion of a moving film electrode when a voltage is applied to the moving film electrode, and showing the hysteresis characteristics of the moving film electrode.
Figure 15:
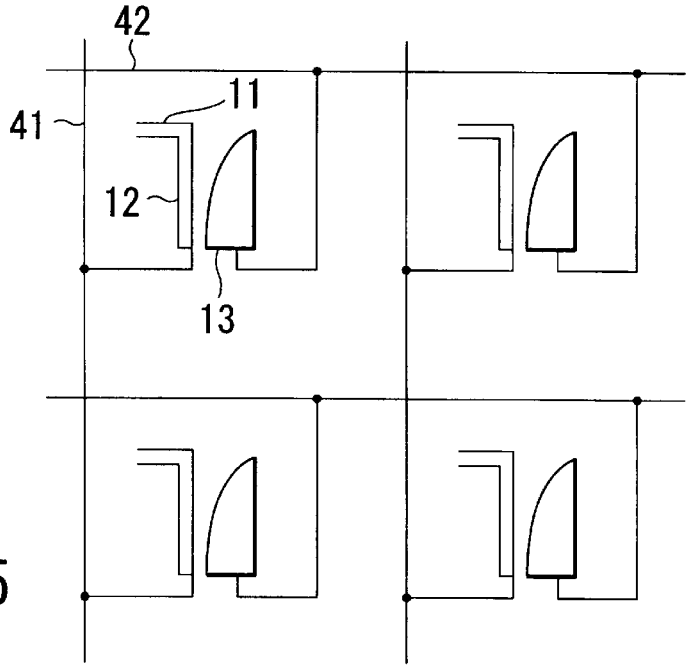
FIG. 15 is a circuit diagram showing a conventional moving-film display device.
Figure 16:
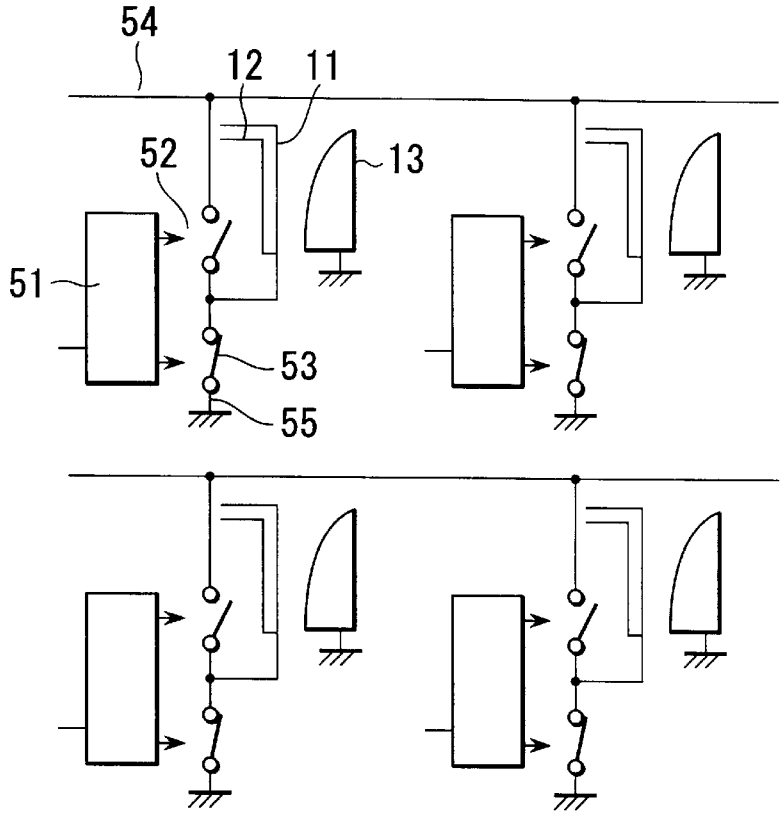
FIG. 16 is a circuit diagram showing another conventional moving-film display device.

The stem 101*s* of the moving film electrode 101 bends on the basis of the potential difference (voltage) between the moving film electrode 101 and the counter electrode 107. As shown in FIG. 14, for example, by selecting an appropriate material for this moving film electrode 101, the moving film electrode 101 can have hysteresis characteristics. So, the displacement amount of the free upper end portion 101*t* changes with the applied voltage as shown in FIG. 14. Accordingly, both the state in which the moving film electrode 101 is attracted to the fixed portion 102 and the state in which it is attracted to the counter electrode 107 are stable.

As shown in FIG. 1, a plurality of signal lines 104 run along pixels in order to give each moving film electrode 101 a signal potential for driving the moving film electrode 101, as an image signal. Each pixel has a TFT (Thin Film Transistor) 105 (an active element) as a semiconductor switch, which selectively connects the moving film electrode 101 to the signal line 104. The source and drain of this TFT 105 are connected to the signal line 104 and the moving film electrode 101, respectively. A plurality of address lines 106 run along pixels in order to give the gate of each TFT 105 an ON/OFF control potential as an address signal for selecting a pixel. Also, a plurality of counter potential lines 108 run along pixels in order to give a counter potential to each counter electrode 107. Additionally, to retain the signal potential given from each signal line 104, a capacitor 103 is formed to connect the node between the TFT 105 and the moving film electrode 101 to a constant-potential portion (in this embodiment, a ground potential portion) different from the counter electrode 107.

The signal lines 104 are driven by a signal line driver 111 and selectively supplied with an image signal. The address lines 106 are driven by an address line driver 112 and selectively supplied with an address signal. The counter potential lines 108 are driven by a common electrode driver 113 and supplied with a common counter potential. A controller 116 controls these drivers 111 to 113.

Figure 2A:
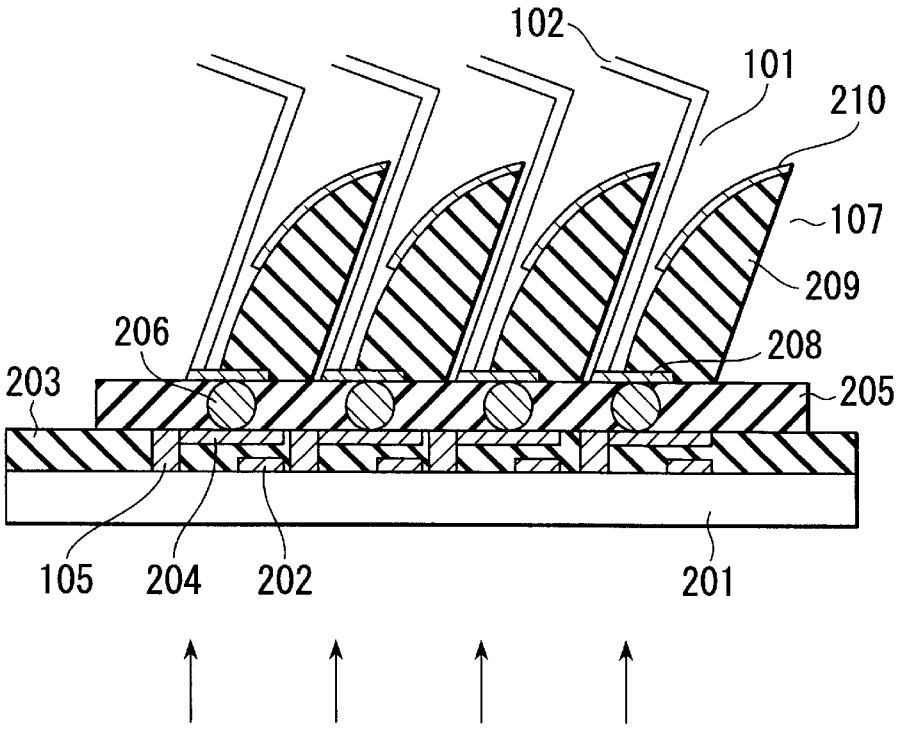
FIGS. 2A and 2B are sectional views showing a central portion along a row of the matrix and a terminal end portion of a column of the matrix, respectively, in the moving-film display device according to the first embodiment.

FIG. 2A is a sectional view showing a central portion along a row of the matrix in the moving-film display device shown in FIG. 1. As shown in FIG. 2A, the TFTs 105 and lower conductor plates 202 for forming capacitors are formed on a glass insulating substrate 201. The TFTs 105 are electrically connected to the signal lines 104 (FIG. 1). The lower conductor plates 202 are electrically connected to the constant-potential portion (in this embodiment, the ground potential portion: FIG. 1). Transparent electrodes 204 (intermediate conductor plates) are formed on the lower conductor plates 202 via a first insulating layer 203. These transparent electrodes 204 are electrically connected to the TFTs 105. The lower conductor plates 202 and the transparent conductor plates 204 form the capacitors 103 (FIG. 1) for holding a signal potential.

Upper conductor plates 208 are formed on the transparent conductor plates 204 via a second insulating layer 205 made of an ultraviolet-curing adhesive. Each pair of the transparent conductor plate 204 and the upper conductor plate 208 are electrically connected by metal spheres 206 dispersed in the second insulating layer 205. On this second insulating layer 205, the moving film electrodes 101, the fixed portions 102, and the counter electrodes 107 are formed such that they rise and oppose each other. Each of The moving film electrodes 101 is electrically connected to and physically supported by the corresponding upper conductor plates 208. Each counter electrode 107 is supported on that curved surface of a support 209 standing on the second insulating layer 205, which opposes the moving film electrode 101. The surface of each counter electrode 107 is coated with an insulating film (not shown).

Figure 2B:
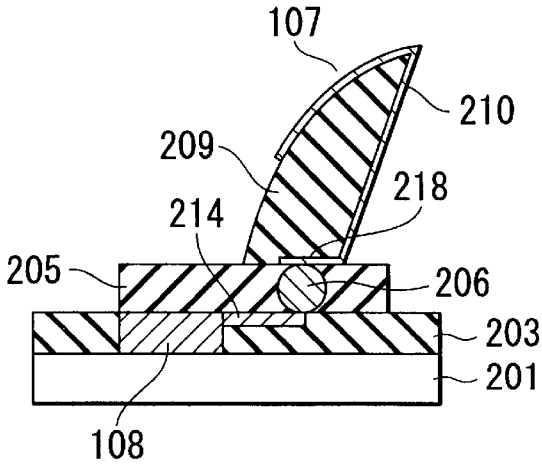

FIG. 2B is a sectional view showing a terminal end portion of a column of the matrix in the moving-film display device shown in FIG. 1. As shown in FIG. 2B, the counter potential line 108 is formed on the substrate 201. A second transparent electrode 214 is formed on the substrate 201 via the first insulating layer 203. This transparent electrode 214 is electrically connected to the counter potential line 108. A second upper conductor plate 218 is formed on the second conductor plate 214 via the second insulating layer 205. Each pair of the second conductor plate 214 and the second upper conductor plate 218 are electrically connected by the metal spheres 216 dispersed in the second insulating layer 205. The second upper conductor plate 218 is further electrically connected to the counter electrode 107. Note that the second transparent conductor plate 214 and the second upper conductor plate 218 are made of the same metal plates as the transparent conductor plate 204 and the upper conductor plate 208, respectively, but are electrically independent of these conductor plates.

A method of forming the moving-film display device according to this embodiment will be described below.

First, as shown in FIG. 2A, lower conductor plates 202 made of, e.g., Mo or Ta are formed on a glass substrate 201 and patterned. These lower conductor plates 202 are connected to constant-potential lines (not shown). Transparent electrodes 204 made of indium tin oxide are formed on the lower conductor plates 202 via a first insulating layer 203 such as a silicon oxide film or a silicon nitride film. TFTs 105 are formed and connected to these transparent electrodes 204. These TFTs can be fabricated in the same manner as when a liquid crystal display device is manufactured. One of the source and drain of each TFT 105, which is not connected to the transparent electrode 204 is connected to the signal line 104 (FIG. 1), and the gate of the TFT 105 is connected to the address line 106 (FIG. 1). The lower conductor plates 202 and the transparent electrodes 204 form capacitors 103.

Subsequently, a second insulating layer 205 in which metal pieces to be used as connecting portions are dispersed is formed. That is, an ultraviolet-curing adhesive consisting primarily of, e.g., an ultraviolet-curing epoxy resin in which metal spheres 206 (metal pieces) made of, e.g., Au, Ag, Cu, Ni, or solder are dispersed is applied.

Moving film electrodes 101 and fixed portions 102 are formed to be connected to these metal spheres 206. Upper conductor plates 208 made of, e.g., Ni, Au, or Al are formed at those ends of the moving film electrodes 101 and the fixed portions 102, which are close to the second insulating layer 205. These upper conductor plates 208 are connected to the transparent electrodes 204 via the metal spheres 206. The second insulating layer 205 is cured by irradiation with ultraviolet rays through the glass substrate 201 and the transparent electrode 204, thereby stabilizing the connection formed between the upper conductor plates 208 and the transparent electrodes 204 via the metal spheres 206. Referring to FIG. 2A, the transparent electrode 204 and the upper conductor plate 208 are connected via one metal sphere 206. In practice, however, each of the electrodes is connected via a plurality of metal spheres 206 since these metal spheres 206 are dispersed in the second insulating layer 205.

The moving film electrodes 101 and the fixed portions 102, formed by coating, e.g., polyethyleneterephthalate, polyimide, or aramid resin with aluminum or the like and having a thickness of about 6 $\mu$m to about 50 $\mu$m, are connected to the upper conductor plates 208. The set of the upper conductor plate 208, the fixed portion 102, and the moving film electrode 101 are electrically connected. The upper end portion of each moving film electrode 101 on the side away from the upper conductor plate 208 is colored in a first color (e.g., black). The upper end portion of each fixed portion 102 on the same side is colored in a second color (e.g., white). The length from those end portions of the moving film electrode 101 and the fixed portion 102, which oppose the upper conductor plate 208 to the colored upper end portions is preferably about 0.5 mm to about 3 mm. The size of one pixel is preferably about 0.05 mm square to about 0.5 mm square.

Subsequently, counter electrodes 107 are formed to oppose the moving film electrodes 101. These counter electrodes 107 are formed by, e.g., vapor-depositing, sputtering, or plating a conductive layer 210 made of Ni, Au, Al, or the like on a support 209 made of, e.g., polyacetal, a liquid crystal polymer, or polyetherimide so formed by injection as to have a curve as shown in FIGS. 2A and 2B. The conductive layer 210 is coated with an insulating film made of, e.g., epoxy, acryl, or silicon. These counter electrodes 107 are not separated but integrated in the column direction (the direction perpendicular to the paper of FIG. 2B).

A display method of the moving-film display device according to this embodiment will be described below.

The moving film electrode 101 and the fixed portion 102 have the same potential, and this potential is controlled by the TFT 105. A potential is supplied to the address line 106 to turn on the TFT 105, thereby making the potential of the capacitor 103 substantially equal to that of the signal line 104. A potential is supplied from the capacitor 103 to the moving film electrode 101 and the fixed portion 102 to produce a potential difference with respect to the counter electrode 107 having a constant potential. Consequently, electrostatic attraction acts between the counter electrode 107 and the moving film electrode 101 to attract the moving film electrode 101 toward the counter electrode 107. As shown in FIG. 13, when viewed in the direction of the arrow, the color of the moving film electrode 101 is seen in each of the pixels P2, P4, and P5 in which the moving film electrodes 101 are not bent. In each of the pixels P1 and P3 in which the moving film electrodes 101 are bent, the color of the fixed portion 102 is seen because the moving film electrode 101 is hidden in the fixed portion 102 of the adjacent pixel.

Images are displayed by thus controlling whether to bend the moving film electrode 101 of each pixel by using the TFT 105. A relatively high aperture ratio is obtained because the bent moving film electrode 101 is hidden under the fixed portion 102 of the adjacent pixel.

To write information in a pixel, a potential is supplied to the address line 106 to turn on the TFT 105, changing the potential of the capacitor 103 to a potential substantially equal to that of the signal line 104. Even when the ON time of the TFT 105 is short and so the moving film electrode 101 does not completely bend toward the counter electrode 107, electric charge builds up because the moving film electrode 101 floats after the TFT 105 is turned off. Electric charge also builds up as auxiliary charge in the capacitor 103. With these charges, the moving film electrode 101 remains bent.

That is, an image can be displayed by turning on the TFT 105 for the time required by the potential of the moving film electrode 101 to become equal to the signal potential, rather than the time required by the moving film electrode 101 to bend toward the counter electrode 107. The existence of the capacitor 103 further increases the switching rate. To separate the bent moving film electrode 101 from the counter electrode 107, the TFT 105 is turned on to discharge the stored electric charge. Consequently, the potentials of the moving film electrode 101 and the counter electrode 107 become close to each other, so the moving film electrode 101 returns to the fixed portion 102 by the elastic force.

In other words, the controller 106 keeps the TFT 105 ON until the potential of the moving film electrode 101 becomes substantially equal to the signal potential, and turns off the TFT 105 before the moving film electrode 101 comes closest to the counter electrode 107. In this embodiment, therefore, information can be written in a pixel although the TFT 105 is turned on for a relatively short time period. This can realize a high-resolution display device and a display of motion images.

In this embodiment, the TFT 105 is connected to the moving film electrode 101 and the fixed portion 102 via the transparent electrode 204 by using the metal spheres 206 dispersed in the second insulating layer 205. This second insulating film 205 made of an ultraviolet-curing adhesive is cured by irradiation with ultraviolet rays through the glass substrate 201 and the transparent electrode 204, thereby stabilizing the connection of the TFT 105 with the moving film electrode 101 and the fixed portion 102 by the metal spheres 206. This method can facilitate connecting the TFT 105 to the moving film electrode 101 and the fixed portion 102. As the second insulating layer 205, an epoxy-based or acryl-based resin is preferably used. As the metal spheres 206, Ni, Au, Ag, or the like is preferred because they have high conductivity.

In this embodiment, the glass substrate 201 and the transparent electrodes 204 are used to increase the transmittance for ultraviolet rays. Therefore, if the above components are connected by heat by using solder or silver paste as the metal spheres 206, no transparent substrate need be used. Instead, a printed circuit board made of, e.g., glass epoxy or polyimide can be used. When this is the case, a heat-hardening adhesive is preferably used as the material of the second insulating layer 205.

In this embodiment, a TFT is used as a switch (active element). However, it is also possible to use, e.g., a thin-film diode, chip transistor, or diode.

Furthermore, when the moving-film display device according to this embodiment is to be used as a large bulletin board or billboard, the device can be formed by a similar formation method by using chip transistors or the like as active elements. When this is the case, the length from those end portions of the moving film electrode 101 and the fixed portion 102, which oppose the upper conductor plate 208 to the colored upper end portions is preferably about 3 mm to about 100 mm. Also, the size of one pixel is preferably about 0.5 mm square to about 10 mm square.

(Second Embodiment)

Figure 3:
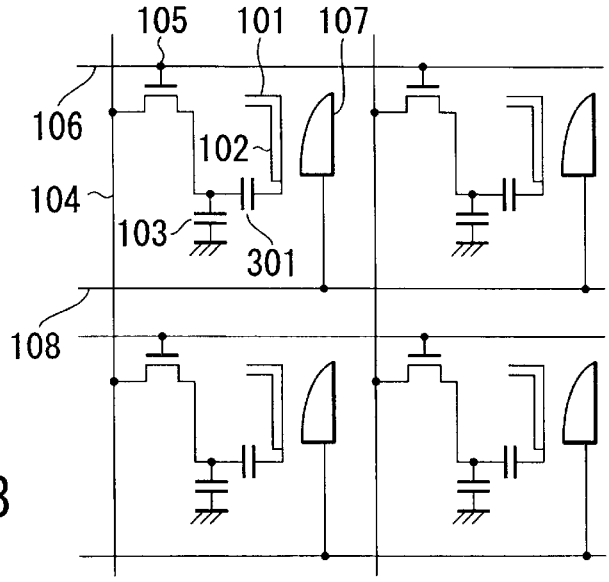
FIG. 3 is a circuit diagram showing a moving-film display device according to the second embodiment of the present invention.

FIG. 3 is a circuit diagram showing a moving-film display device according to the second embodiment of the present invention. This embodiment differs from the first embodiment in that a TFT 105 is connected to a moving film electrode 101 and a fixed portion 102 via an intermediate capacitor 301.

Figure 4A:
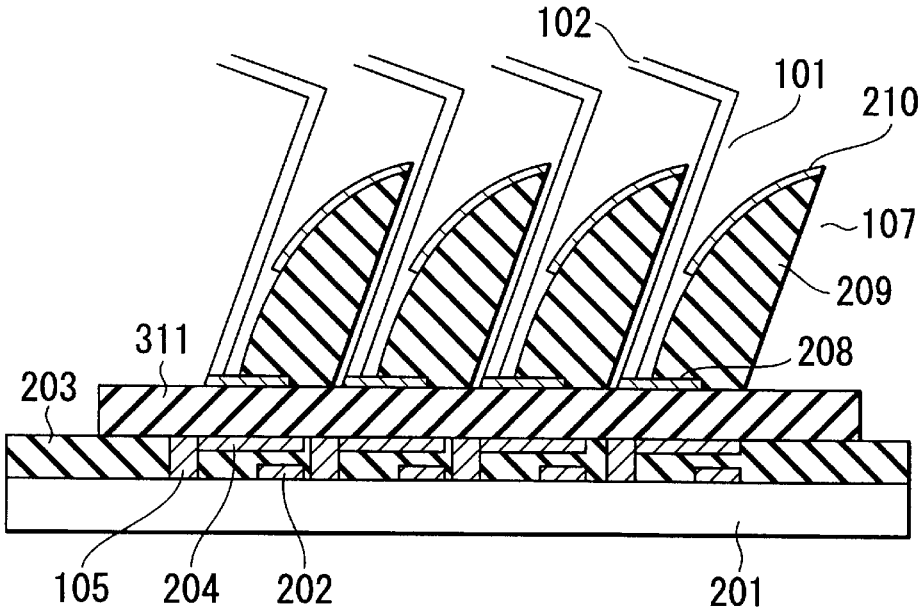
FIGS. 4A and 4B are sectional views showing a central portion along a row of the matrix and a terminal end portion of a column of the matrix, respectively, in the moving-film display device according to the second embodiment.
Figure 4B:
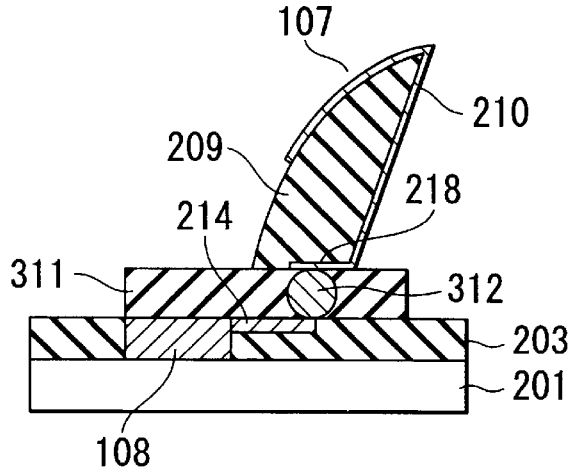

FIGS. 4A and 4B are sectional views showing a central portion along a row of the matrix and a terminal end portion of a column of the matrix, respectively, in the moving-film display device according to the second embodiment. A method of manufacturing a moving-film display device according to this embodiment will be described below with reference to FIGS. 4A and 4B.

First, as shown in FIG. 4A, lower conductor plates 202, a first insulating layer 203, transparent electrodes 204, and TFTs 105 are formed using the same materials and methods as in the first embodiment. Subsequently, a film made of an epoxy resin or the like is formed to have a film thickness of about 20 $\mu$m as a second insulating layer 311.

On this second insulating layer 311, upper conductor plates 208, moving film electrodes 101, fixed portions 102, and counter electrodes 107 are formed using the same materials and methods as in the first embodiment, thereby completing a moving-film display device according to this embodiment. In this embodiment, the intermediate capacitor 301 is formed by the transparent electrode 204 and the upper conductor plate 308 which sandwich the second insulating layer 311 therebetween.

FIG. 4B is a view showing a terminal end portion in the column direction (the direction perpendicular to the paper of FIG. 4B) of the moving-film display device according to this embodiment. As shown in FIG. 4B, in a position where a terminal end portion in the column direction of the counter electrodes 107 to be formed later is formed, a connecting material 312 made of, e.g., Au, Ag, or Ni is dispersed in the second insulating layer 311 so that a conductive layer 210 and a second transparent electrode 214 are electrically connected, and the resultant material is applied.

A display method of the moving-film display device according to this embodiment is substantially the same as the first embodiment except the following. That is, the TFT 105 is turned on to make the potential of a capacitor 103 substantially equal to that of a signal line 104. The capacitor 103 then supplies a potential to the intermediate capacitor 301, thereby supplying a potential to the moving film electrode 101 and the fixed portion 102.

As in the first embodiment, even in the moving-film display device having the intermediate capacitor 301 according to this embodiment, the TFT 105 needs to be turned on only for the time required by electric charge to build up in the capacitor 103. Accordingly, the time required to write information in one pixel can be shortened. This makes it possible to realize a high-resolution display device and a display of motion images.

Furthermore, in the moving-film display device according to this embodiment, the transparent electrode 204 and the upper conductor plate 208 are connected via the intermediate capacitor 301. That is, the display device can operate even when the transparent electrode 204 and the upper conductor plate 208 are not electrically connected and are electrically coupled via the intermediate capacitor 301. Also, the moving film electrodes 101, the fixed portions 102, and the counter electrodes 107 can be formed on the array of the TFTs 105 via only the second insulating layer 311. This effectively simplifies the manufacturing method.

(Third Embodiment)

Figure 5:
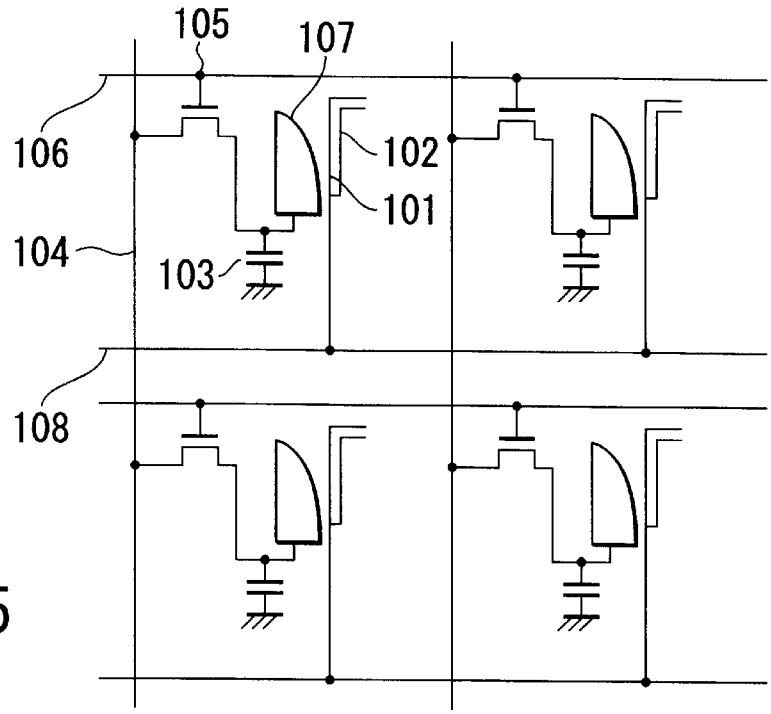
FIG. 5 is a circuit diagram showing a moving-film display device according to the third embodiment of the present invention.

FIG. 5 is a circuit diagram showing a moving-film display device according to the third embodiment of the present invention. This embodiment differs from the first embodiment in that a moving film electrode 101 and a fixed portion 102 are connected to a counter potential line 108 and thereby set at the same potential, and the potential of a counter electrode 107 is controlled by a TFT 105.

Figure 6A:
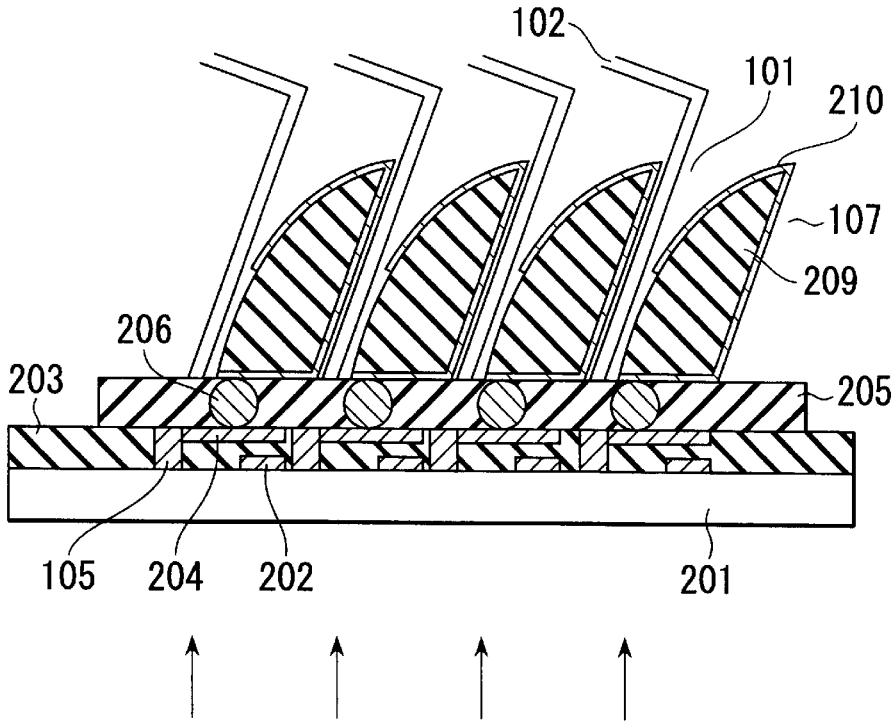
FIGS. 6A and 6B are sectional views showing a central portion along a row of the matrix and a terminal end portion of a column of the matrix, respectively, in the moving-film display device according to the third embodiment.
Figure 6B:
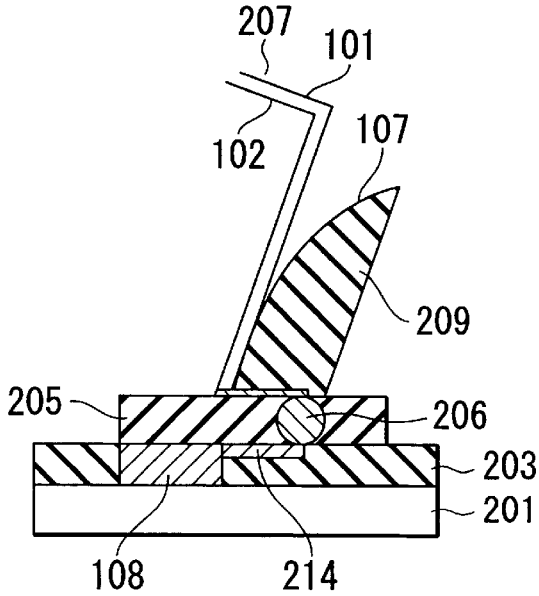

FIGS. 6A and 6B are sectional views showing a central portion along a row of the matrix and a terminal end portion of a column of the matrix, respectively, in the moving-film display device according to the third embodiment. A method of manufacturing the moving-film display device according to this embodiment will be described below with reference to FIGS. 6A and 6B.

First, as shown in FIG. 6A, the steps from the formation of lower conductor plates 202 on a glass substrate 201 to the application of a material formed by dispersing metal spheres 206 in a second insulating layer 205 are performed using the same materials and methods as in the first embodiment. In this embodiment, however, a conductive layer 210 of counter electrodes 107 is separated into pixels. Also, that surface of the conductive layer 210 of each pixel, which is in contact with the second insulating layer 205 in which the metal spheres 206 are dispersed is not coated with any insulating film. When the second insulating layer 205 is cured by irradiation with ultraviolet rays through the glass substrate 201 and transparent electrodes 204, the conductive layer 210 of each pixel is stably connected to the transparent electrode 204 of the corresponding TFT 105 via the metal spheres 206.

Subsequently, moving film electrodes 101 and fixed portions 102 are formed using the same materials and methods as in the first embodiment. The moving film electrodes 101 and the fixed portions 102 are electrically connected. All the moving film electrodes 101 and the fixed portions 102 in the column direction (the direction perpendicular to the paper of FIG. 6A) are electrically connected and integrated near one end close to the second insulating layer 205. FIG. 6B is a view showing a terminal end portion in the column direction of the moving-film display device according to this embodiment. As shown in FIG. 6B, a terminal end portion in the column direction of the moving film electrode 101 and the fixed portion 102 is connected to the counter potential line 108 via the metal spheres 206 and a second transparent electrode 214.

Even when the moving film electrode 101 and the fixed portion 102 are set at the same potential and the potential of the counter electrode 107 is controlled by the TFT 105 as in this embodiment, the same effect as in the first embodiment can be obtained. That is, since the TFT 105 needs to be turned on only for the time required by the potential of the counter electrode 107 to become substantially the same as the signal potential, the time required to write information in one pixel can be shortened. Hence, it is possible to realize a high-resolution display device and a display of motion images.

(Fourth Embodiment)

Figure 7:
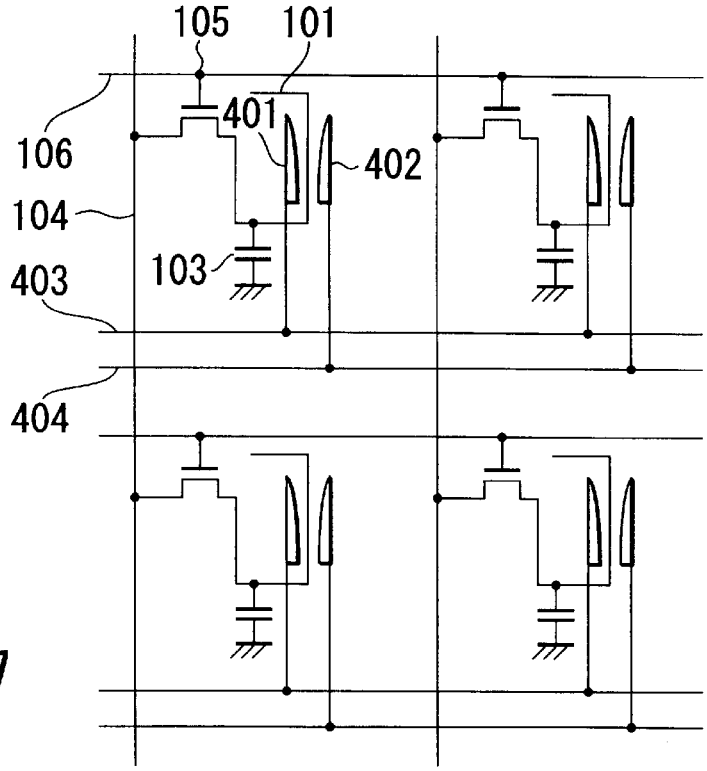
FIG. 7 is a circuit diagram showing a moving-film display device according to the fourth embodiment of the present invention.

FIG. 7 is a circuit diagram showing a moving-film display device according to the fourth embodiment of the present invention. This embodiment differs from the first embodiment in that a moving film electrode 101 is sandwiched between a first counter electrode 401 and a second counter electrode 402, that these first and second counter electrodes 401 and 402 have different potentials, and that a fixed portion 102 is formed by an insulator.

Figure 8A:
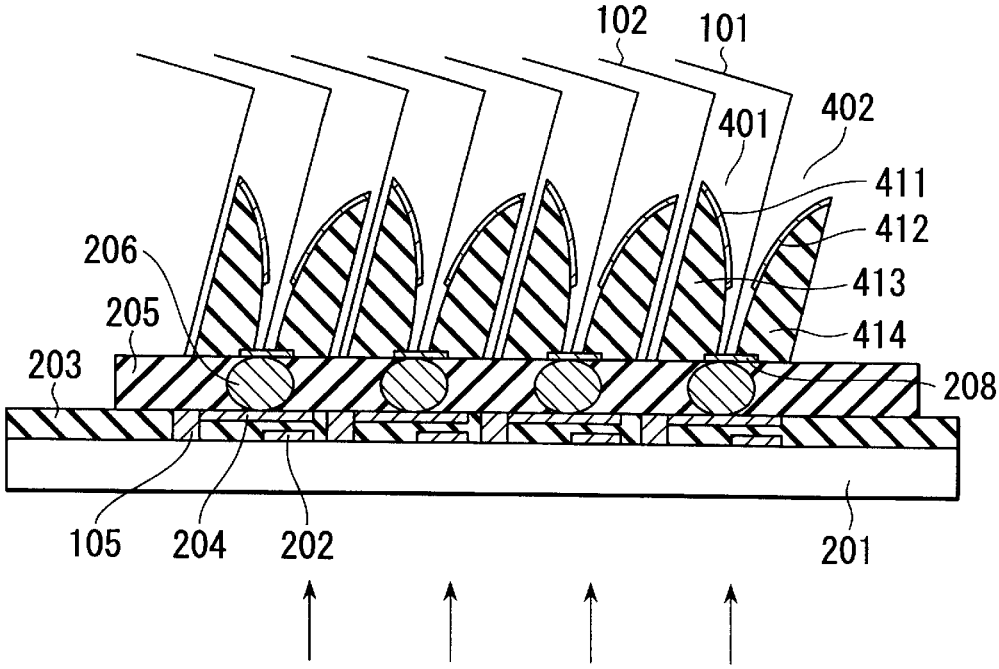
FIGS. 8A and 8B are sectional views showing a central portion along a row of the matrix and a terminal end portion of a column of the matrix, respectively, in the moving-film display device according to the fourth embodiment.
Figure 8B:
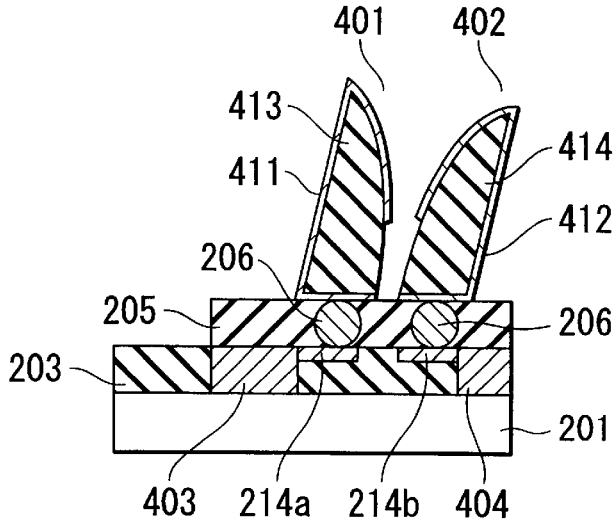

FIGS. 8A and 8B are sectional views showing a central portion along a row of the matrix and a terminal end portion of a column of the matrix, respectively, in the moving-film display device according to the fourth embodiment. A display method of the moving-film display device according to this embodiment will be described below with reference to FIGS. 8A and 8B.

First, as shown in FIG. 8A, the steps from the formation of lower conductor plates 202 on a glass substrate 201 to the application of a material formed by dispersing metal spheres 206 in a second insulating layer 205 and the connection of this material to upper conductor plates 208 are performed using the same materials and methods as in the first embodiment.

Subsequently, moving film electrodes 101 formed by coating, e.g., polyethyleneterephthalate, polyimide, or an aramid resin with aluminum or the like and having a thickness of about 6 $\mu$m to about 50 $\mu$m are fixed on the upper conductor plates 208, thereby electrically connecting the moving film electrodes 101 and the upper conductor plates 208.

Subsequently, a first counter electrode 401 and a second counter electrode 402 are formed on the two sides of each moving film electrode 101. These first and second counter electrodes 401 and 402 are formed by vapor-depositing, sputtering, or plating first and second conductive layers 411 and 412 made of, e.g., Au, Al, or Ni on first and second supports 413 and 414, respectively, having curved surfaces and made of, e.g., polyacetal, polyetherimide, or a liquid crystal polymer. The first and second conductive layers 411 and 412 are coated with an insulating film made of epoxy, acryl, silicon, or the like. The curved surfaces of the first and second supports 413 and 414 oppose each other on the two sides of the moving film electrode 101. The first and second counter electrodes 401 and 402 are not separated but integrated in the column direction (the direction perpendicular to the paper of FIG. 8B). FIG. 8B is a view showing a terminal end portion in the column direction of the moving-film display device according to this embodiment. As shown in FIG. 8B, in a terminal end portion in the column direction of the first and second counter electrodes 401 and 402, the first and second conductive layers 411 and 412 are connected to first and second counter potential lines 403 and 404 via metal spheres 206 and electrically independent transparent electrodes 214*a* and 214*b*, respectively. The first and second counter potential lines 403 and 404 have different potentials.

A fixed portion 102 made of, e.g., polyethyleneterephthalate, polyimide, or an aramid resin is formed between uncurved surfaces of the first and second counter electrodes 401 and 402. In this embodiment, this fixed portion 102 is an insulator. The upper end portion of the moving film electrode 101 on the side away from the second insulating layer 205 is colored in a first color (e.g., black). The upper end portion of the fixed portion 102 on the same side is colored in a second color (e.g., white). The length from those end portions of the moving film electrode 101 and the fixed portion 102, which oppose the second insulating layer 205 to the colored upper end portions is preferably about 0.5 mm to about 3 mm. The size of one pixel is preferably about 0.05 mm square to about 0.5 mm square.

A display method of the moving-film display device according to this embodiment will be described below. In this display method of the moving-film display device according to this embodiment, bending of the moving film electrode 101 is controlled by potential differences between the moving film electrode 101 and the first and second counter electrodes 401 and 402. This is the difference from the first embodiment in which bending of the moving film electrode 101 is controlled by the potential difference between the moving film electrode and the counter electrode.

That is, the first and second counter electrodes 401 and 402 are connected to the first and second counter potential lines 403 and 404, respectively, having different potentials, and the potential of the moving film electrode 101 is changed by a TFT 105. A potential is supplied to an address line 106 to turn on the TFT 105, thereby storing, in a capacitor 103, electric charge by which the potential of the moving film electrode 101 becomes equal to that of the first counter potential line 403. Consequently, the moving film electrode 101 is attracted to the second counter electrode 402. Also, a potential is supplied to the address line 106 to turn on the TFT 105, thereby storing, in the capacitor 103, electric charge by which the potential of the moving film electrode 101 becomes equal to that of the second counter potential line 404. Consequently, the moving film electrode 101 is attracted to the first counter electrode 401. In this embodiment, bending of the moving film electrode 101 is controlled by using the first and second counter electrodes 401 and 402. Therefore, the fixed portion 102 is formed by an insulator and does not participate in the bending control of the moving film electrode 101.

Even in the moving-film display device having the two counter electrodes, i.e., the first and second counter electrodes according to this embodiment, the same effect as in the first embodiment can be obtained. That is, since the TFT 105 needs to be turned on only for the time required by the potential of the moving film electrode 101 to become substantially the same as the signal potential, a time required to write information in one pixel can be shortened. Hence, it is possible to realize a high-resolution display device and a display of motion images.

Furthermore, in the moving-film display device according to this embodiment, bending of the moving film electrode 101 is controlled by both the electrostatic force resulting from the potential difference between the moving film electrode 101 and the first counter electrode 401 and the electrostatic force resulting from the potential difference between the moving film electrode 101 and the second counter electrode 402. In the moving-film display device according to the first embodiment, electrostatic force acts between the moving film electrode and only one counter electrode, and the moving film electrode is moved toward the fixed portion by using the elastic force of the moving film electrode. In the first embodiment, therefore, the moving velocity of the moving film electrode is determined by the material and dimensions of the moving film electrode, i.e., by the elastic force of the moving film electrode, and cannot be increased more than that. However, in this embodiment the moving film electrode 101 is moved by electrostatic force in either direction. This can raise the moving velocity of the moving film electrode 101.

(Fifth Embodiment)

Figure 9:
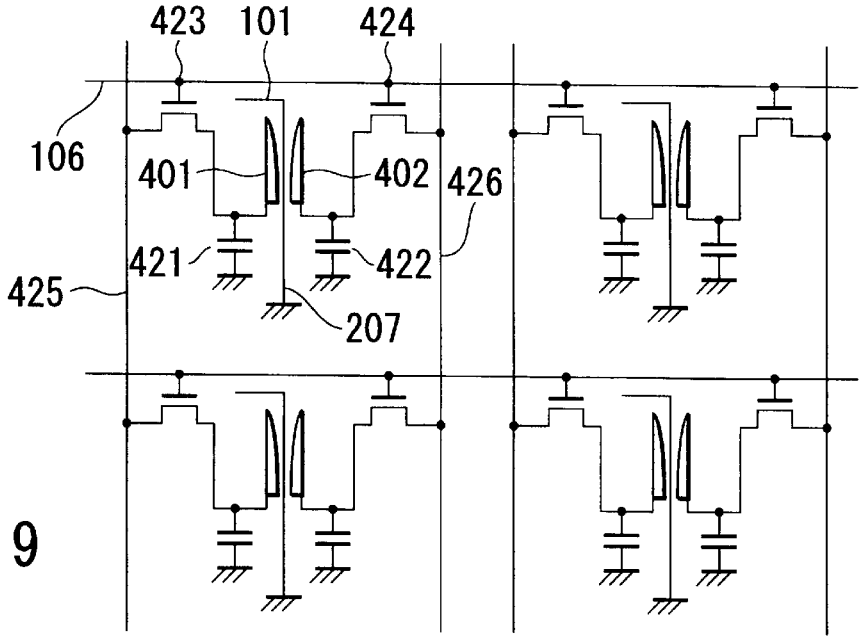
FIG. 9 is a circuit diagram showing a moving-film display device according to the fifth embodiment of the present invention.

FIG. 9 is a circuit diagram showing a moving-film display device according to the fifth embodiment of the present invention. This embodiment differs from the fourth embodiment in that a moving film electrode 101 is connected to a ground line 207, and the potentials of first and second counter electrodes 401 and 402 are controlled by first and second TFTs 423 and 424 (active elements), respectively.

Figure 10A:
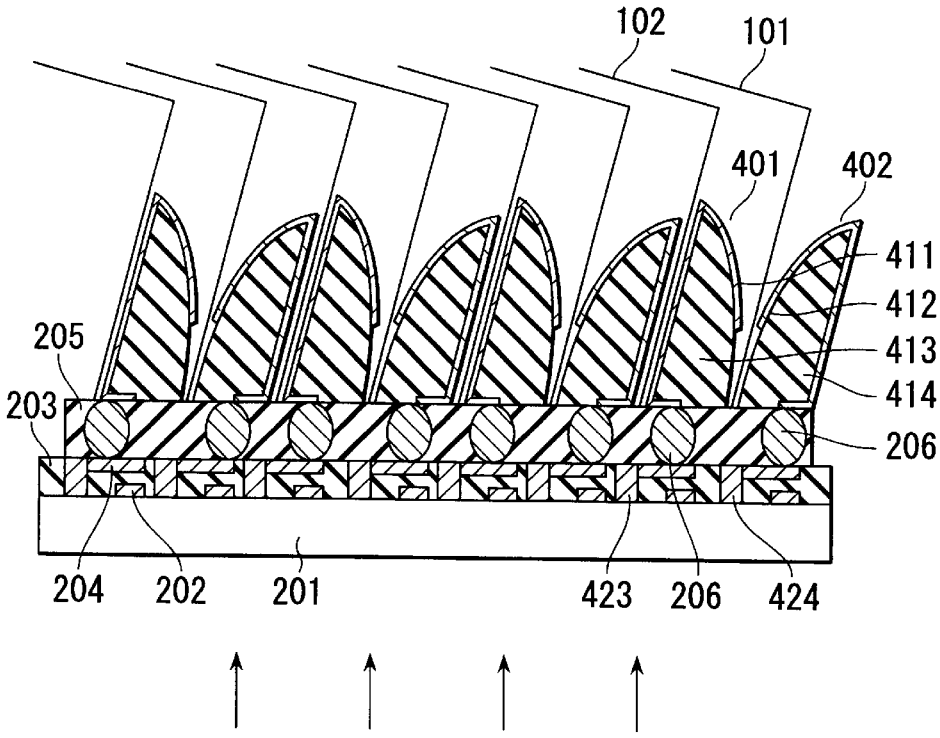
FIGS. 10A and 10B are sectional views showing a central portion along a row of the matrix and a terminal end portion of a column of the matrix, respectively, in the moving-film display device according to the fifth embodiment.
Figure 10B:
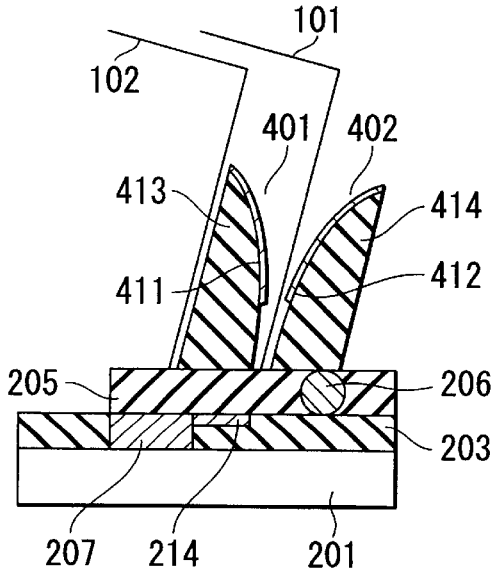

FIGS. 10A and 10B are sectional views showing a central portion along a row of the matrix and a terminal end portion of a column of the matrix, respectively, in the moving-film display device according to the fifth embodiment. A method of manufacturing the moving-film display device according to this embodiment will be described below with reference to FIGS. 10A and 10B.

First, as shown in FIG. 10A, the steps from the formation of lower conductor plates 202 on a glass substrate 201 to the application of a material formed by dispersing metal spheres 206 in a second insulating layer 205 are performed using the same materials and methods as in the fourth embodiment.

First and second counter electrodes 401 and 402 connecting to the metal spheres 206 are then formed using the same material and method as in the fourth embodiment. However, first and second conductive layers 411 and 412 corresponding to these first and second counter electrodes 411 and 412, respectively, are separated into pixels. Those surfaces of the first and second conductive layers 411 and 412 of each pixel, which are in contact with the second insulating layer 205 in which the metal spheres 206 are dispersed are not coated with any insulating film. When the second insulating layer 205 is cured by irradiation with ultraviolet rays through the glass substrate 201 and transparent electrodes 204, the first and second conductive layers 411 and 412 of each pixel stably connect to corresponding transparent electrodes 204 via the metal spheres 206.

Subsequently, moving film electrodes 101 and fixed portions 102 are formed using the same materials and methods as in the fourth embodiment. All the moving film electrodes 101 in the column direction (the direction perpendicular to the paper of FIG. 10A) are electrically connected and integrated near one end close to the second insulating layer 205. FIG. 10B is a view showing a terminal end portion in the column direction of the moving-film display device according to this embodiment. As shown in FIG. 10B, a terminal end portion in the column direction of the moving film electrode 101 is connected to the ground line 207 via the metal spheres 206 and the transparent electrode 204.

Even when the potential of the moving film electrode 101 is held constant and the potentials of the first and second counter conductive layers 411 and 412 are controlled by the first and second TFTs 423 and 424, respectively, as in this embodiment, the same effect as in the fourth embodiment can be obtained. That is, since the TFTs 423 and 424 need to be turned on only for the time required by the potentials of the first and second counter electrodes 401 and 402, respectively, to become equal to the signal potential, the time required to write information in one pixel can be shortened. Hence, it is possible to realize a high-resolution display device and a display of motion images.

Additionally, in this embodiment the moving film electrode 101 is moved by electrostatic force in either direction, as in the fourth embodiment. This can raise the moving velocity of the moving film electrode 101.

(Sixth Embodiment)

Figure 11:
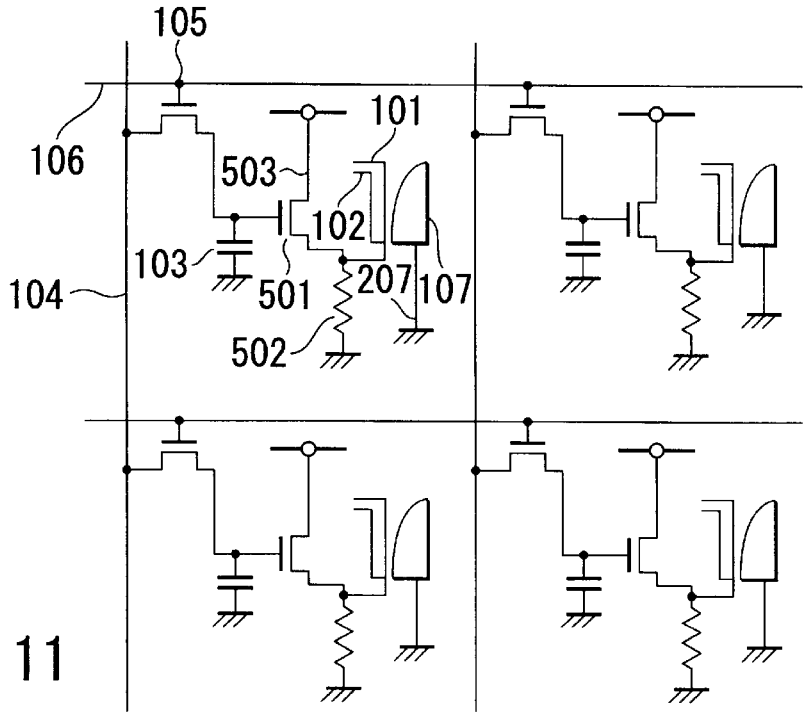
FIG. 11 is a circuit diagram showing a moving-film display device according to the sixth embodiment of the present invention.

FIG. 11 is a circuit diagram showing a moving-film display device according to the sixth embodiment of the present invention. This embodiment differs from the first embodiment in that an intermediate TFT 501 (an active element) as a semiconductor switch and a resistor 502 are added to each pixel to stabilize potentials.

As shown in FIG. 11, the moving-film display device according to this embodiment includes a moving film electrode 101 and a fixed portion 102 having the same potential, and a counter electrode 107 connected to a ground line (counter potential line) 207. The resistor 502 connects the moving film electrode 101 and the fixed portion 102 to a ground potential portion. One of the source and drain of the intermediate TFT 501 is connected to the resistor 502, and the other is connected to a writing potential line 503 for supplying a constant writing potential, e.g., different from a signal potential. The gate of the intermediate TFT 501 is connected to one of the source and drain of a first TFT 105 and to a capacitor 103. The other of the source and drain of this first TFT 105 is connected to a signal line 104. The gate of the first TFT 105 is connected to an address line 106.

Individual components of the moving-film display device according to this embodiment are formed in the same way as in FIGS. 2A and 2B. The intermediate TFTs 501 and the resistors 502 having a TFT structure are formed in the same layer as the TFTs 105 shown in FIG. 2A.

A display method of the moving-film display device according to this embodiment will be described below. The difference of this display method of the moving-film display device according to this embodiment from the first embodiment is a method of supplying potentials to the moving film electrode 101 and the fixed portion 102.

In this embodiment, when the intermediate TFT 501 is not turned on, the moving film electrode 101 and the fixed portion 102 have a potential close to the ground on the side of the resistor 502, so the moving film electrode 101 does not bend. When the address line 106 is driven to turn on the first TFT 105, electric charge from the signal line 104 builds up in the capacitor 103. This electric charge turns on the intermediate TFT 501 to make the potential of the moving film electrode 101 and the fixed portion 102 close to that of the writing potential line 503, thereby bending the moving film electrode 101.

As in the first embodiment, in this embodiment the TFT 105 needs to be turned on only for the time required by electric charge to build up in the capacitor 103. Since this can shorten the time required to write information in one pixel, it is possible to realize a high-resolution display device and a display of motion images.

Also, in this embodiment, the intermediate TFT 501 is kept ON while electric charge builds up in the capacitor 103, so an electric current is kept supplied from the writing potential line 503 during this period. Accordingly, this embodiment has an effect of achieving a stabler operation while making the signal potential application time equal to a short time required by electric charge to build up in the capacitor 103.

(Seventh Embodiment)

Figure 17:
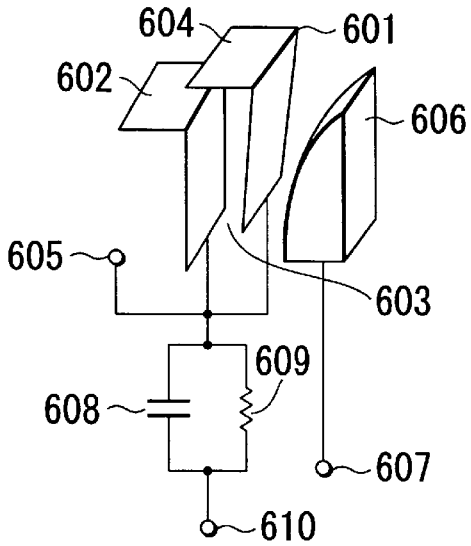
FIG. 17 is a circuit diagram showing one pixel of a moving-film display device according to the seventh embodiment of the present invention.
Figure 18:
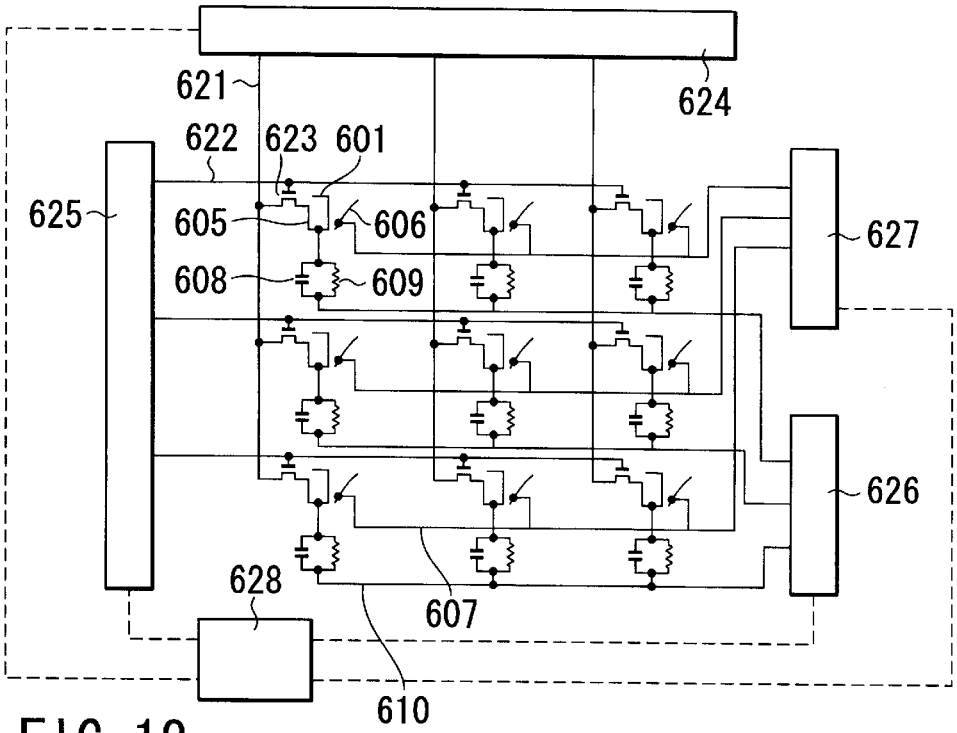
FIG. 18 is a circuit diagram showing the whole configuration of the moving-film display device according to the seventh embodiment.

FIG. 17 is a circuit diagram showing one pixel of a moving-film display device according to the seventh embodiment of the present invention. FIG. 18 is a circuit diagram showing the whole configuration of the moving-film display device according to the seventh embodiment.

As shown in FIG. 17, one pixel of the moving-film display device according to this embodiment includes a moving film electrode 601 having a fixed end 603 and a displacement end 604 which can be displaced, and a fixed portion 602 having the same potential as the moving film electrode 601. The fixed portion 602 and the moving film electrode 601 are connected to a moving film electrode line 605. A counter electrode 606 opposes the moving film electrode 601. The surfaces of this counter electrode 606 are coated with an insulating film (not shown). The upper end portion, i.e., the displacement end 604 of the moving film electrode 601 is colored in a first color (e.g., white). The upper end portion of the fixed portion 602 is colored in a second color (e.g., black).

As shown in FIG. 18, this moving-film display device has a pixel matrix, i.e., an array defined by rows and columns of a plurality of pixels. As shown in FIG. 18, a plurality of signal lines 621 run along pixels in order to give each moving film electrode 601 a signal potential for driving the moving film electrode 601, as an image signal. Each pixel has a TFT 623 as a semiconductor switch, which selectively connects the moving film electrode 601 to the signal line 621. The source and drain of this TFT 623 are connected to the signal line 621 and the moving film electrode 601, respectively. A plurality of address lines 622 run along pixels in order to give the gate of each TFT 623 an ON/OFF control potential as an address signal for selecting a pixel.

Also, a plurality of first constant-potential lines 607 and a plurality of second constant-potential lines 610 run along pixels. The first constant-potential lines 607 are connected to the counter electrodes 606. Resistors 609 and capacitors 608 are connected in parallel so as to connect the moving film electrode lines 605 to the second constant-potential lines 610. To retain the signal potential given from each signal line 621, the capacitor 608 connects the node between the TFT 623 and the moving film electrode 601 to the second constant-potential line 610. The resistor 609 forms a bypass parallel to the capacitor 108 in order to release electric charge from the capacitor 108.

The signal lines 621 are driven by a signal line driver 624 and selectively supplied with an image signal. The address lines 622 are driven by an address line driver 625 and selectively supplied with an address signal. The first constant-potential lines 607 are supplied with a predetermined potential by a first common electrode driver 627. The second constant-potential lines 610 are supplied with a predetermined potential by a second common electrode driver 626. It is also possible to supply the same potential to the first and second constant-potential lines 607 and 610 from a common electrode driver, without using the two, first and second common electrode drivers 627 and 626. A controller 628 controls these drivers 624 to 627.

A display method of the moving-film display device according to this embodiment will be described below.

First, the address line driver 625 turns on all the TFTs 623 connected to one address line 622. The signal line driver 624 is then driven to supply a signal potential to each signal line 621. Consequently, an electric current corresponding to the signal flows through all the TFTs 623 connected to the address line 622, and a potential corresponding to the signal is supplied to the moving film electrodes 601. As explained earlier with reference to FIG. 13, in a pixel in which a potential difference is produced between the moving film electrode 601 and the counter electrode 606, the moving film electrode 601 bends as it is attracted to the counter electrode 606 by electrostatic force. Since the bent moving film electrode 601 hides under the fixed portion 602 of the adjacent pixel, the second color is displayed. In a pixel in which no potential difference, i.e., no electrostatic force is produced between the moving film electrode 601 and the counter electrode 606 and so the moving film electrode 601 does not bend, the first color of the displacement end 604 of the moving film electrode 601 is displayed.

Figure 19:
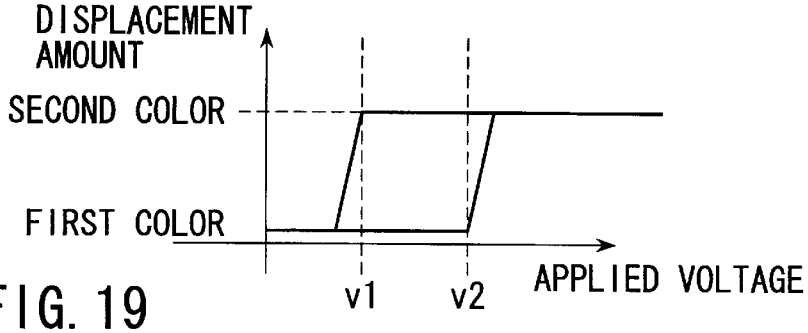
FIG. 19 is a graph for explaining the hysteresis characteristics of a moving film electrode, which shows the displacement amount of a displacement end portion of the moving film electrode when a voltage is applied to the moving film electrode.

FIG. 19 shows the relationship between the applied voltage and the displacement amount of the displacement end 604 of the moving film electrode 601 when the address line 622 is driven to turn on the TFT 623 and the voltage is applied to the moving film electrode 601.

When no voltage is applied to the moving film electrode 601, the moving film electrode 601 does not bend, so the first color is displayed. When the applied voltage to the moving film electrode 601 exceeds $V_2$, the electrostatic force of the moving film electrode 601 exceeds its elastic force, and the moving film electrode 601 bends. Consequently, the moving film electrode 601 hides under the fixed portion 602 of the adjacent pixel, so the second color is displayed. Even when the voltage is lowered after that, the moving film electrode 601 remains bent for a while, so the second color is displayed. When the applied voltage becomes equal to or less than $V_1$, the elastic force of the moving film electrode 601 exceeds its electrostatic force. Therefore, the bent moving film electrode 601 returns to its original position, and the first color is displayed. That is, FIG. 19 shows that the moving film electrode 601 has hysteresis characteristics with respect to the applied voltage.

In the moving-film display device according to this embodiment, the resistor 609 and the capacitor 608 in parallel with each other are connected to the moving film electrode 601. Accordingly, a voltage applied to the moving film electrode 601 is released with a certain time constant to perform a time gradation display.

Assume that the portion between the counter electrode 606 and the moving film electrode 601 has a capacitance $C_1$ because this portion is coated with an insulating film, and let $C_2$ be the capacitance of the capacitor 608 and R be the resistance of the resistor 609. Then, the potential drops with time in a pixel constructed as shown in FIG. 17. Assume that after a voltage $V_0$ is given to the moving film electrode 601, the moving film electrode 601 is set to float and a time t has passed. A voltage $V_t$ of the moving film electrode 601 after that is represented by $$V_t = V_0 \times exp(-t/\{(C_1+C_2)\times R\}) \quad (1)$$

Figure 20:
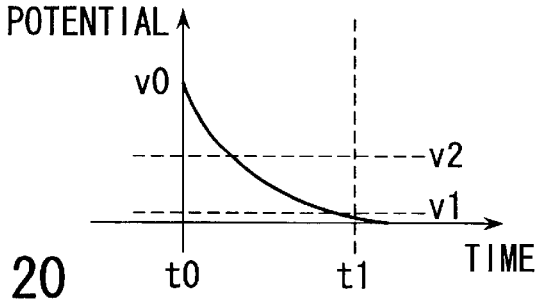
FIG. 20 is a graph showing the way the potential reduces with time when a resistor and capacitor in parallel with each other are connected to the moving film electrode and the moving film electrode is set to float after being applied with a voltage.

From equation (1) above, when the moving film electrode 601 is set to float after the TFT 623 is turned on at time 0 to apply the voltage $V_0$ to the moving film electrode 601, a reduction in the voltage of the moving film electrode 601 is as shown in FIG. 20. Since $V_0$ is larger than $V_2$, the moving film electrode 601 stays bent for the time from $t_0$ to $t_1$ during which the potential of the moving film electrode 601 changes from $V_0$ to $V_1$.

Figure 21:
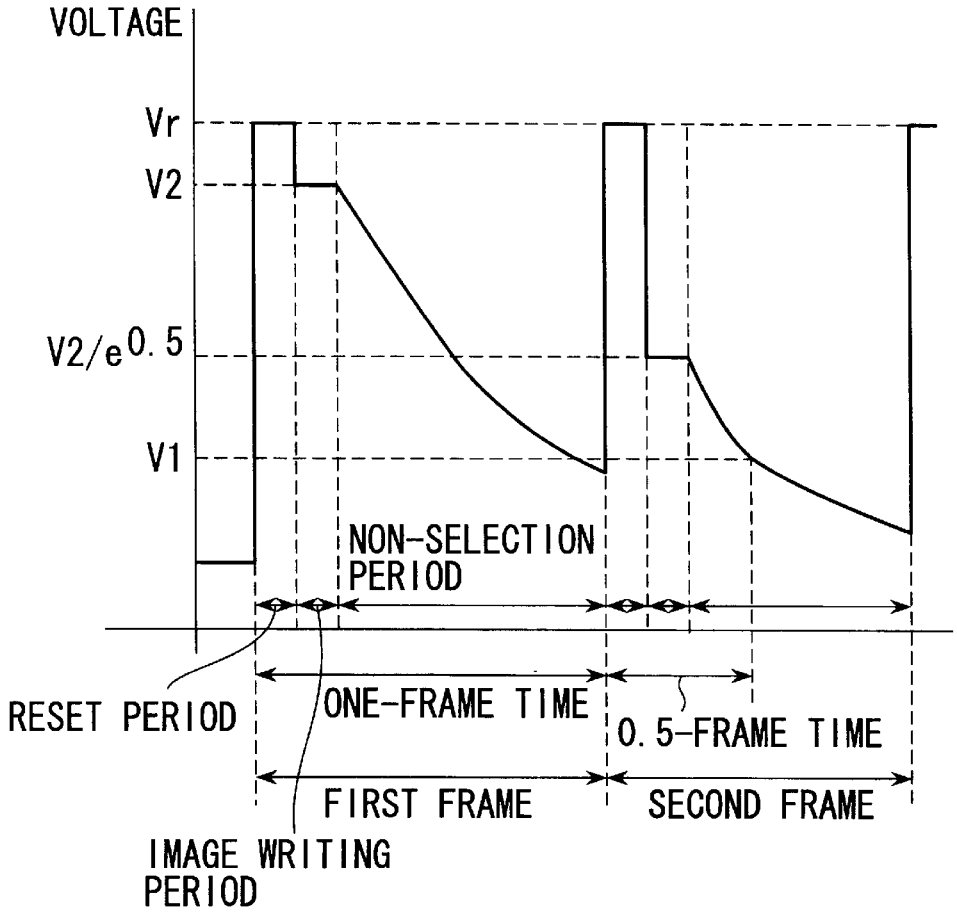
FIG. 21 is a graph showing the potential of the moving film electrode during a two-frame time.

FIG. 21 shows changes in the potential of the moving film electrode 601 according to this embodiment with time when a pulse voltage is applied to the moving film electrode 601. FIG. 21 shows the time of two frames. The controller 628 defines the time during which one frame is displayed as a one-frame time, and divides this one-frame time into a reset period, image writing period, and non-selection period. The controller 628 performs a gradation display by bending the moving film electrode 601 by conducting the following control.

First, the controller 628 applies a voltage $V_r$ to bend the moving film electrode in the reset period and then applies a voltage corresponding to a signal in the image writing period. In this manner, the controller 628 determines the time during which the moving film electrode is kept bent to display the second color in the subsequent non-selection period. The reset period and the image writing period are short, and the non-selection period occupies most of the one-frame time. During this non-selection period, no signal voltage is applied to a pixel of interest (because the TFT 623 of the pixel is turned off), and the signal voltage is applied to another pixel.

After a voltage $V_2$ is applied to the moving film electrode 601 during the image writing period, the moving film electrode 601 is set to float. The time until the potential $V_1$ at which the bent moving film electrode 601 returns to its original state is defined as a time constant $(C_1+C_2)\times R$ in equation (1). When this time constant $(C_1+C_2)\times R$ is made equal to the one-frame time, the potential of the moving film electrode 601 reduces from $V_2$ to $V_1$ as indicated by the one-frame time in FIG. 21. Therefore, when this one-frame time has elapsed, the bent moving film electrode 601 returns to its original potential, and the display changes from the second to the first color.

To reduce the potential in a 0.5-frame time to allow the potential of the moving film electrode 601 to reach $V_1$ in the second frame, the applied voltage to the moving film electrode 601 need only be set to $V_2/e^{0.5}$ from equation (1). In this case, the potential of the moving film electrode 601 reduces from $V_2/e^{0.5}$ to $V_1$ in the 0.5-frame time. Accordingly, when the 0.5-frame time has elapsed, the bent moving film electrode 601 returns to its original state, and the display changes from the second to the first color.

In this embodiment, $V_{in}$ applied in the image writing period is set by $$V_{in} = V_1 \times e^L \quad (2)$$

In this way, the moving film electrode 601 is bent to display the second color for an L-frame time ($0<L\leqq 1$), thereby performing a gradation display. When the moving film electrode 601 is not to bend, i.e., when the first color is to be displayed throughout the whole one-frame time, no voltage is applied during the reset period and the image writing period.

Figure 22:
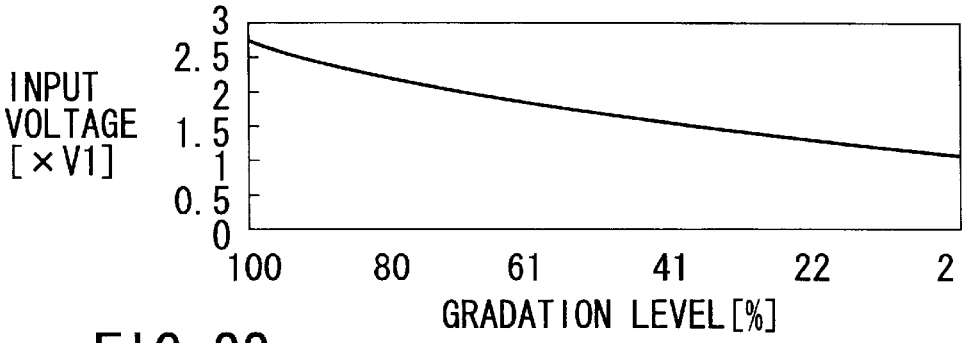
FIG. 22 is a graph showing the relationship between the input voltage to and the gradation level of the moving film electrode.

FIG. 22 shows the relationship between the input voltage ($V_{in}$) and the gradation level ($L\times 100$), i.e., the ratio of the time during which the second color is displayed in the one-frame time. This relationship corresponds to equation (2). In this embodiment as described above, the time during which the moving film electrode 601 remains bent to display the second color in the one-frame time is changed by changing the voltage applied to the moving film electrode 601, thereby performing a gradation display.

Figure 23:
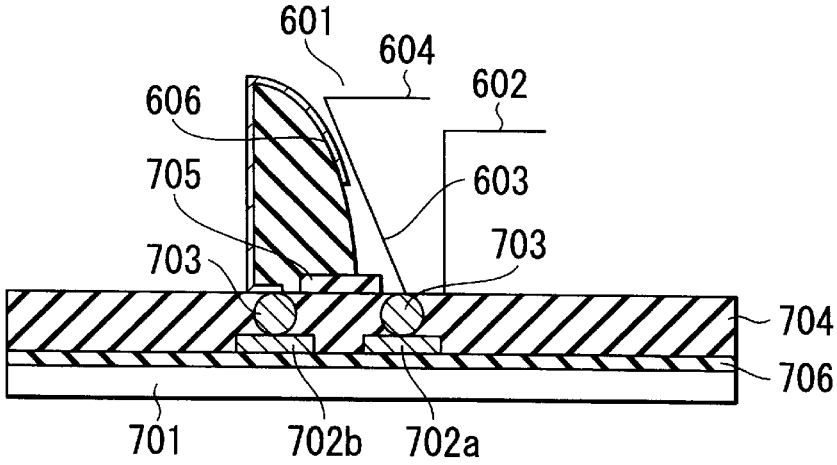
FIG. 23 is a sectional view showing the moving-film display device according to the seventh embodiment.

FIG. 23 is a sectional view showing the moving-film display device according to the seventh embodiment. A method of manufacturing the moving-film display device according to this embodiment will be described below with reference to FIG. 23.

On a glass insulating substrate 701, connecting electrodes 702*a* and 702*b* electrically isolated from each other via a first insulating layer 706 are formed. A second insulating layer 704 made of an ultraviolet-curing adhesive is formed on the first insulating layer 706. On this second insulating layer 704, a moving film electrode 601, a fixed portion 602, and a counter electrode 606 are formed such that they rise and oppose each other. The connecting electrode 702*a* is electrically connected to the moving film electrode 601 and the fixed portion 602 by metal spheres 703 dispersed in the second insulating layer 704. The connecting electrode 702*b* and the counter electrode 606 are also electrically connected by metal spheres 703 dispersed in the second insulating layer 704. The connecting electrode 702*a* connected to the fixed portion 602 and the moving film electrode 601 is connected to the moving film electrode line 605 (FIG. 17). The connecting electrode 702*b* connected to the counter electrode 606 is connected to the first constant-potential line 607 (FIG. 17). Note that the counter electrode 606 is insulated from the fixed portion 602 and the moving film electrode 601 by an insulating portion 705.

In the manufacture of the moving-film display device according to this embodiment, a first insulating layer 706 made of $SiO_2$ is first formed on a substrate 701 made of, e.g., glass. On this first insulating layer 706, connecting electrodes 702*a* and 702*b* made of, e.g., ITO are formed and patterned. These connecting electrodes 702*a* and 702*b* are connected to the first constant-potential line 607 or to the TFT 623, the resistor 609, and the capacitor 608 via the moving film electrode line 605 (FIG. 17). The TFT 623 and its lines can be formed in the same manner as for a liquid crystal display device. Formation methods of the resistor 609 and the capacitor 608 will be described later.

After these elements are formed, the connecting electrodes 702*a* and 702*b* are coated with an adhesive layer 704 in which metal spheres 703 are dispersed. These metal spheres 703 are made of, e.g., Au, Ag, or Ni. The adhesive layer 704 is made of, e.g., an epoxy resin, acrylic resin, silicone-based resin, or ultraviolet-curing anisotropic conductive paste. When an ultraviolet-curing anisotropic conductive paste is to be used, the substrate 701 and the connecting electrodes 702*a* and 702*b* are made of materials highly transparent to ultraviolet rays. This allows the adhesive layer 704 to be cured by irradiation with ultraviolet rays from the back side of the substrate 701.

A fixed portion 602, a moving film electrode 601, and a counter electrode 606 are formed to be connected to the metal spheres 703. Both the fixed portion 602 and the moving film electrode 601 are formed by sputtering, vapor-depositing, or plating a metal such as Ni, Au, Cu, or Al on a resin made of, e.g., PET, polyimide, or aramid. The counter electrode 606 is formed by injecting a resin made of, e.g., polyacetal, a liquid crystal polymer, or polyetherimide to obtain a shape having a curved surface as shown in FIG. 23, and vapor-depositing, sputtering, or plating a metal such as Ni, Au, Cu, or Al. The surface opposing the moving film electrode 601 is coated with an insulating film.

The fixed portion 602, the moving film electrode 601, and the counter electrode 606 are so fixed as to be electrically connected to the metal spheres 703. The fixed portion 602 and the moving film electrode 601 are insulated from the counter electrode 606 by an insulating portion 705 formed by electro-deposition of, e.g., an epoxy resin, acrylic resin, or silicone. Referring to FIG. 23, the counter electrode 606 is connected to the connecting electrode 702*b* via one metal sphere 703, and the fixed portion 602 and the moving film electrode 601 are connected to the connecting electrode 702*a* via one metal sphere 703. In practice, however, these metal spheres 703 are dispersed in the adhesive layer 704, so each of the electrodes is connected via a plurality of metal spheres 703.

Figure 24A:
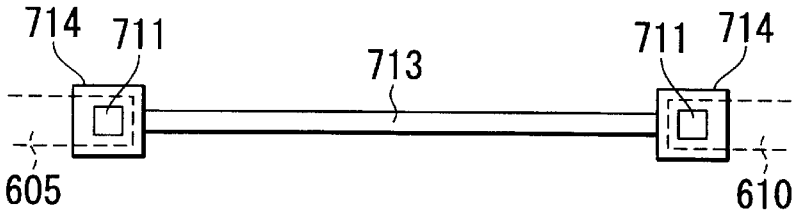
FIGS. 24A and 24B are a plan view and sectional view, respectively, showing a resistor of the moving film electrode according to the seventh embodiment.
Figure 24B:
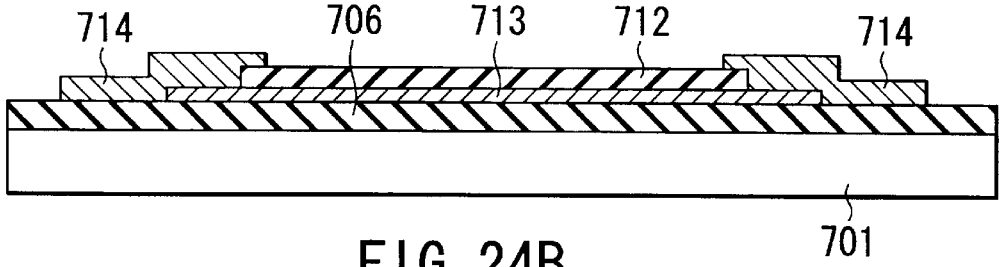

FIGS. 24A and 24B are a plan view and sectional view, respectively, showing the resistor 609. A method of forming the resistor 609 will be described below with reference to FIGS. 24A and 24B.

On the first insulating layer 706 on the substrate 701, a resistance layer 713 made of, e.g., polysilicon, amorphous silicon, or a semiconductor material doped with a slight amount of an impurity, is formed to have a film thickness of about 0.5 $\mu$m to about 5 $\mu$m. An $SiN_x$ passivation film 712 is formed and patterned on this resistance layer 713 by CVD. First electrode portions 714 made of, e.g., Al, W, or Mo are formed at end portions of the resistance layer 713, and connected to the moving film electrode line 605 and the second constant-potential line 610 via contact portions 711.

Letting $\rho$ be the resistivity of the resistance layer 713 and W and L be the width and length, respectively, of the resistance layer 713, a resistance R of the resistance layer 713 is given by $$R=\rho\times L/W \tag{3}$$

When L=100 $\mu$m, W=1 $\mu$m, and $\rho=1\times10^7$ $\Omega$m, for example, R=10 G$\Omega$.

Figure 25A:
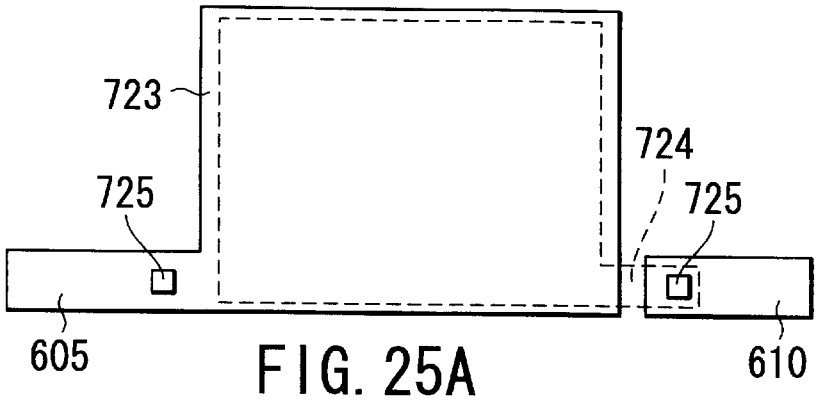
FIGS. 25A and 25B are a plan view and sectional view, respectively, showing a capacitor of the moving film electrode according to the seventh embodiment.
Figure 25B:
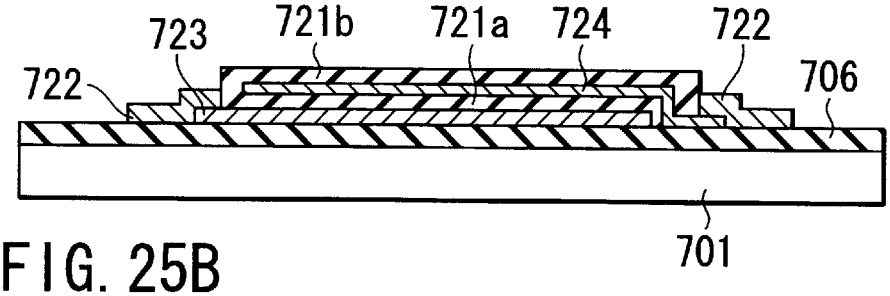

FIGS. 25A and 25B are a plan view and sectional view, respectively, showing the capacitor 608. A method of forming the capacitor 608 will be described below with reference to FIGS. 25A and 25B.

On the first insulating layer 706 on the substrate 701, a first electrode layer 723 made of, e.g., Al, W, or Mo, an $SiO_2$ insulating layer 721*a*, a second electrode layer 724 made of, e.g., Al, W, or Mo, and an $SiO_2$ insulating layer 721*b* are stacked in this order. The film thickness of the first and second electrode layers 723 and 724 is about 0.5 $\mu$m to about 5 $\mu$m, and the film thickness of the insulating layers 721*a* and 721*b* is about 0.1 $\mu$m to about 1 $\mu$m. The first and second electrode layers 723 and 724 are insulated by the insulating layer 721 to form a capacitor 608. Second electrode portions 722 are formed at end portions of these first and second electrode layers 723 and 724, and connected to the moving film electrode line 605 and the second constant-potential line 610 via contact portions 725.

Letting $\epsilon_S$ be the dielectric constant of the insulating layer 721, S be the area of the first and second electrodes 723 and 724, and d be the distance between the first and second electrodes 723 and 724, a capacitance $C_2$ of the capacitor 608 is given by $$C_2=\epsilon_0\epsilon_S S/d \tag{4}$$

When S=14,000 $\mu m^2$ (140 $\mu$m×100 $\mu$m), d=300 nm, $\epsilon_S=4$, and vacuum dielectric constant $\epsilon_0=8.85\times10^{12}$ F/m, for example, $C_2$=1.65 pF.

The dimensions of each of the moving film electrode 601 and the counter electrode 606 are 0.1 mm×1 mm, and the thickness of a polyethyleneterephthalate insulating film having a relative dielectric constant of 4 formed between these electrodes is 100 $\mu$m. In this case, a capacitance $C_1$ formed between the moving film electrode 601 and the counter electrode 606 is 0.035 pF, and the synthetic capacitance is $C_1+C_2$=1.685 pF.

As described above, when the time constant $(C_1+C_2)\times R$ is made equal to the one-frame time, the potential reduces in the one-frame time, so the potential of the moving film electrode 601 reduces from $V_2$ to $V_1$. Accordingly, when this one-frame time has elapsed, the bent moving film electrode 601 returns to its original position, and the display changes from the second to the first color. When the above-mentioned resistance and capacitances are used, the time constant is given by the following equation.

$$(C_1+C_2)\times R$$

$$=(0.035\times10^{-12}+1.65\times10^{-12})\times10\times10^{9}$$

$$=16.85\times10^{-3}\ sec$$

The one-frame time is usually 1/60 sec, i.e., approximately 16.7 msec. In this embodiment, therefore, the voltage to be applied to the moving film electrode 601 can be changed by using the resistance and capacitances described above, thereby performing a gradation display.

In this embodiment, a gradation display is performed by changing the voltage to be applied to the moving film electrode only by inserting a fine resistor and capacitor in each pixel. This makes the formation of a high-resolution display device feasible. Also, since a display time for the gradation display is determined only by the magnitude of the voltage to be applied to the moving film electrode, the signal frequency does not rise. Therefore, a large display device and a high-resolution display device can be formed.

Figure 29:
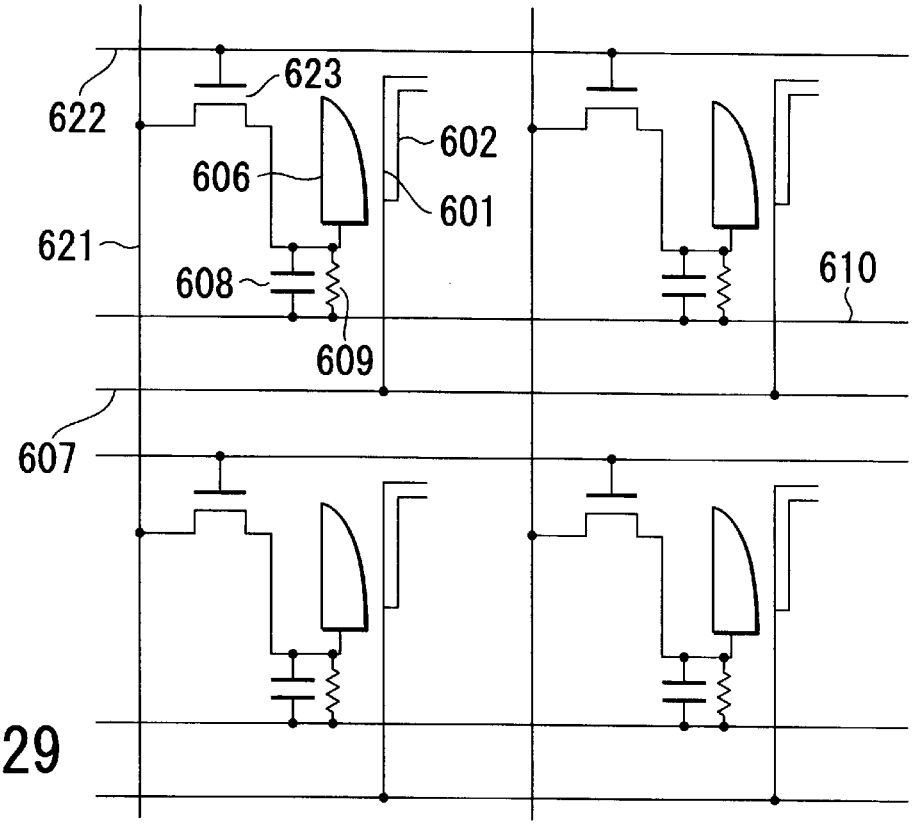
FIG. 29 is a circuit diagram showing a moving-film display device according to a modification of the seventh embodiment.

In this embodiment, the TFT 623, the capacitor 608, and the resistor 609 are connected to the fixed portion 602 and the moving film electrode 601, and the first constant-potential line 607 is connected to the counter electrode 606. However, as shown in FIG. 29, the display device can also be driven when the first constant-potential line 607 is connected to the fixed portion 602 and the moving film electrode 601, and the TFT 623, the capacitor 608, and the resistor 609 are connected to the counter electrode 606.

(Eighth Embodiment)

Figure 26:
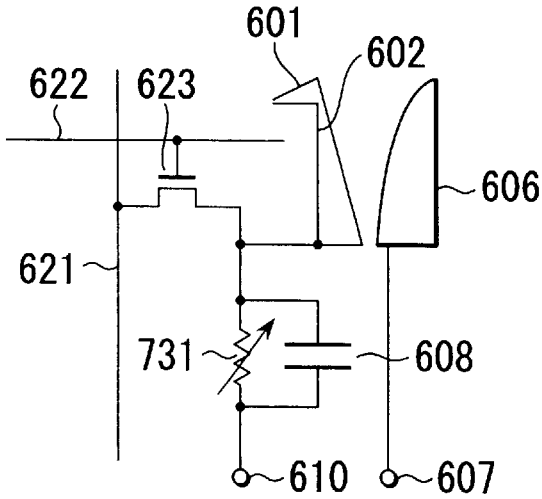
FIG. 26 is a circuit diagram showing one pixel of a moving-film display device according to the eighth embodiment of the present invention.

FIG. 26 is a circuit diagram showing one pixel of a moving-film display device according to the eighth embodiment of the present invention. This embodiment differs from the seventh embodiment in that the resistance value of a resistor 731 connected to a moving film electrode 601 is variable.

The moving-film display device according to this embodiment can be formed by the same method as the seventh embodiment. Therefore, only a method of forming the resistor 731 different from the seventh embodiment will be explained. The resistor 731 of this embodiment can be formed by the three-terminal CMOS technology.

Figure 27A:
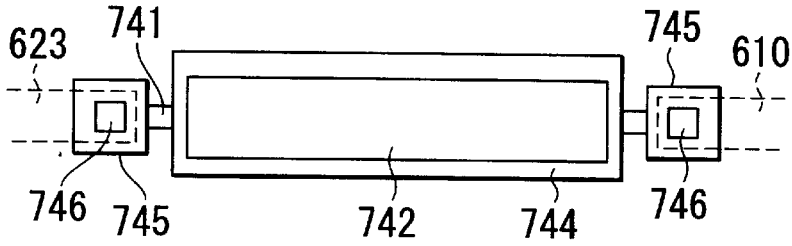
FIGS. 27A and 27B are a plan view and sectional view, respectively, showing a variable resistor of a moving film electrode according to the eighth embodiment.
Figure 27B:
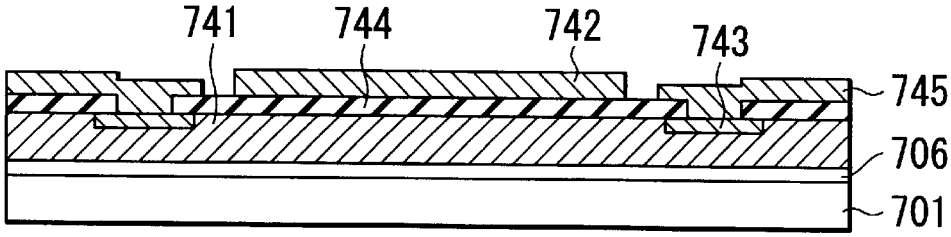

FIGS. 27A and 27B are a plan view and sectional view, respectively, showing the resistor 731. The method of forming the resistor 731 will be described below with reference to FIGS. 27A and 27B.

As shown in FIG. 27B, a p-type amorphous silicon resistance layer 741 is formed on a first insulating layer 706 on a substrate 701, and an $SiO_2$ oxide film 744 is formed on this resistance layer 741. As or Sb is doped into the resistance layer 741 by using the oxide layer 744 as a mask, thereby forming an $n^+$ doped layer 743. On this $n^+$ doped layer 743, third electrode portions 745 made of Al and a gate electrode 742 made of, e.g., Mo, W, or Ta are formed. The resistance layer 741 and the third electrode portions 745 are in ohmic contact by the $n^+$ doped layer 743. Also, the third electrode portions 745 are connected to a TFT 623 and a second constant-potential line 610 via contact portions 746.

This embodiment is similar to the seventh embodiment in that a gradation display is performed by changing the voltage to be applied to the moving film electrode only by inserting a fine resistor and capacitor in each pixel. This makes the formation of a high-resolution display device feasible. Also, since a display time for the gradation display is determined only by the magnitude of the voltage to be applied to the moving film electrode, the signal frequency does not rise. Therefore, a large display device and a high-resolution display device can be formed.

Furthermore, in this embodiment, when a voltage is applied to the gate electrode 742 the resistance value of the resistance layer 741 changes in accordance with the value of the applied voltage. This change in the resistance value permits control of a time constant when the voltage reduces while the moving film electrode 601 is set to float. Controlling the time constant makes control of the contrast and luminance of the whole screen possible. Also, color unevenness on the screen can be adjusted by changing the gate voltage from one pixel or region to another.

Figure 28:
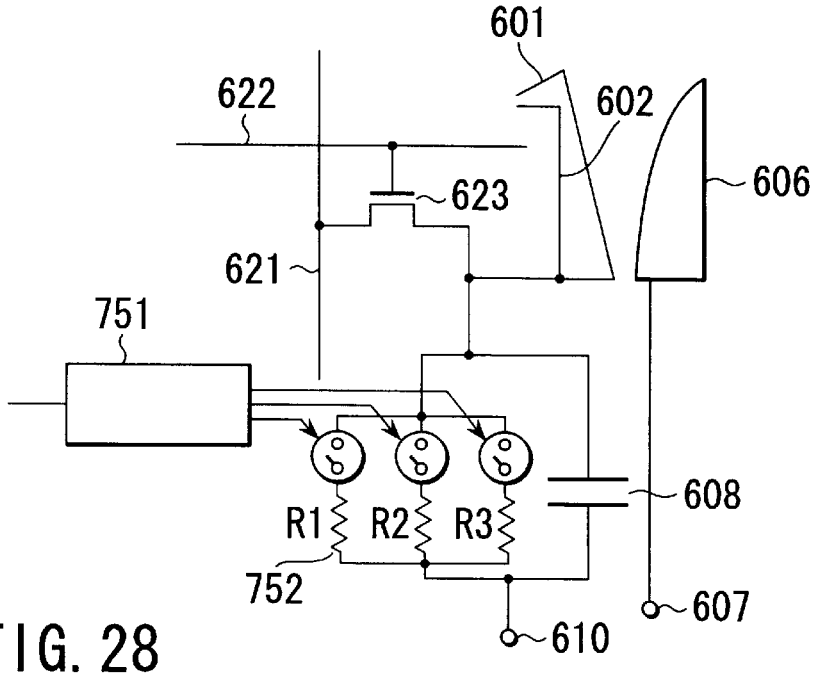
FIG. 28 is a circuit diagram showing one pixel of a moving-film display device according to a modification of the eighth embodiment.

As shown in FIG. 28, it is possible to form a variable resistor potion 752 by a plurality of resistors R1, R2, and R3 and select a resistance value by using a data memory 751 which holds information of the characteristics of each pixel. It is also possible to rewrite the information stored in this data memory and change the display characteristics of each pixel in accordance with an image to be displayed. This can be used as color unevenness correction. Furthermore, the luminance can be adjusted in accordance with, e.g., the intensity of ambient light by selectively using the resistors R1, R2, and R3 throughout the entire screen.

In the seventh and eighth embodiments, a gradation display can be performed even when a high-resolution image is to be displayed or a large display device is to be formed. In each embodiment, a method of performing a gradation display only on a moving-film display device is explained. However, the present invention is not limited to these embodiments. For example, the characteristic features of these embodiments are well applicable to a liquid crystal display device using a ferroelectric liquid crystal and to a display device, such as an electrochromic display (ECD), which performs a binary operation. Also, even in a display device, such as an FED or ELD, which performs an operation with a number of gradation levels, a gradation display can be performed by changing the light emission amount corresponding to a signal voltage in each frame or changing the change rate when an optical response changes with time, by connecting a resistor and capacitor in parallel as in the present invention. In this case, the resistor and capacitor in parallel with each other are connected to a line for supplying a signal voltage to each pixel, in order to obtain the above effects.

Figure 30A:
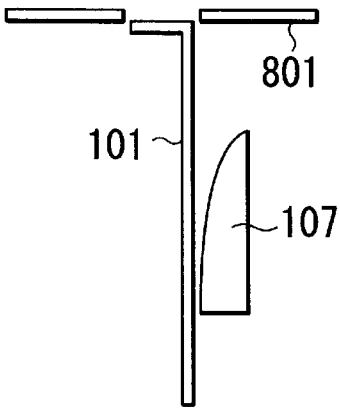
FIGS. 30A and 30B are side views showing a moving-film display device according to a modification of the first to eighth embodiments.
Figure 30B:
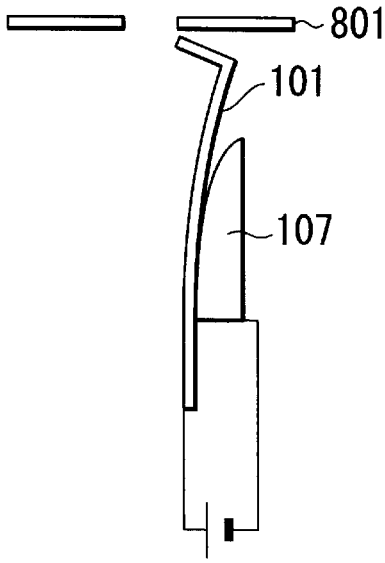

In the first to eighth embodiments, to obtain a display color of each pixel, the upper end portions of the moving film electrode 101 or 601 and the fixed portion 102 or 602 standing side by side are colored in different colors. However, in constructing a moving-film display device, the fixed portion 102 or 602 used in these embodiments is not always necessary. For example, in a moving-film display device according to a modification shown in FIGS. 30A and 30B, a moving film electrode 101 and a counter electrode 107 are disposed in a window frame 801, and the upper end portion of the moving film electrode 101 is colored. In this structure, the display color of each pixel is determined in accordance with whether the end portion of the moving film electrode 101 is or is not seen through the opening of the window frame 801 by bending of the moving film electrode 101.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A moving-film display device comprising:

a pixel matrix defined by rows and columns of a plurality of pixels, each of said pixels comprising, first and second electrodes, one of said first and second electrodes being a moving film electrode capable of bending, at least its end portion having a colored portion, the other of said first and second electrodes-being a counter electrode which opposes said moving film electrode, and an internal switch disposed in each of the pixels and configured to be selectively connected to said first electrode;

a plurality of signal lines, each connected to the internal switches of disposed in the pixels arranged in a row in order to supply an image signal for driving said first electrodes;

a signal line driver configured to selectively supply the image signal to said signal lines;

a plurality of counter potential lines, each connected to the second electrodes of pixels arranged in a column in order to give a counter potential to said second electrodes;

a plurality of address lines, each of the address lines supplying a control signal to said internal switches for selecting said pixels; and a controller configured to control said signal lines, said counter potential lines, said address lines, and said internal switches;

address lines, and said internal switches;

wherein a display color of each pixel is determined when said moving film electrode bends by a potential difference between said moving film electrode and said counter electrode.

2. The device according to claim 1, wherein said controller supplies said control signal to a selected internal switch disposed in a pixel and turns off the internal switch when the potential of said first electrode becomes substantially equal to the signal potential, or when said moving film electrode comes close to said counter electrode to a predetermined distance.

3. The device according to claim 1, wherein each of said pixels further comprises a first capacitor connected to a node between said internal switch and said first electrode in order to hold the signal potential given from said signal line, said first capacitor being disposed as a capacitor different from a capacitor formed by the first and second electrodes.

4. The device according to claim 1, wherein said internal switch is a MOS transistor, a source and a drain of which are connected to said signal line and said first electrode, respectively, and having a gate connected to said address line.

5. The device according to claim 1, wherein said first electrode is said moving film electrode and said second electrode is said counter electrode.

6. The device according to claim 1, wherein said first electrode is said counter electrode and said second electrode is said moving film electrode.

7. The device according to claim 1, wherein each of said pixels further comprises a second capacitor connecting said first electrode to said internal switch.

8. The device according to claim 1, wherein each of said pixels further comprises a third electrode which opposes said moving film electrode, and the moving film electrode is disposed between the counter electrode and the third electrode.

9. The device according to claim 8, wherein said first electrode is said moving film electrode, said second electrode is said counter electrode, and said third electrode is given another counter potential different from the counter potential.

10. The device according to claim 8, wherein said first electrode is said counter electrode, said second electrode is said moving film electrode, and said third electrode is given another signal potential different from the signal potential.

11. The device according to claim 1, wherein each of said pixels further comprises an intermediate switch configured to selectively supply a writing potential to said first electrode, said intermediate switch being controlled by said image signal.

12. The device according to claim 11, wherein each of said pixels further comprises a resistor connected to a node between said intermediate switch and said first electrode.

13. The device according to claim 1, wherein said colored portion has a first color, and each of said pixels further comprises a portion which has a second color different from the first color.

14. A moving-film display device comprising a pixel matrix defined by rows and columns of a plurality of pixels disposed on an insulating substrate, wherein each of said pixels comprises:

a semiconductor switch disposed on said substrate and electrically connected to a signal line;

an intermediate conductor plate disposed on said substrate via a first insulating layer and electrically connected to said switch;

an upper conductor plate disposed on said intermediate conductor plate via a second insulating layer, said intermediate conductor plate and said upper conductor plate being electrically coupled with each other; and a pair of electrodes including first and second electrodes which oppose each other while standing on said second insulating layer, said first electrode being electrically connected to said upper conductor plate, said second electrode being given a counter potential, one of said first and second electrodes being a moving film electrode which has a colored portion in an upper end portion and can bend, the other one of said first and second electrodes being a counter electrode which opposes said moving film electrode, and a display color of each pixel being determined when said moving film electrode bends by a potential difference between said moving film electrode and said counter electrode.

15. The device according to claim 14, further comprising, in each of said pixels, a third electrode as another counter electrode which opposes said moving film electrode while standing on said second insulating layer, wherein said moving film electrode is placed between the two counter electrodes.

16. The device according to claim 15, wherein said first electrode is said moving film electrode, said second electrode is said counter electrode, and said third electrode is given another counter potential different from the counter potential.

17. The device according to claim 15, wherein said first electrode is said counter electrode, said second electrode is said moving film electrode, said third electrode is given another signal potential different from the signal potential, and another semiconductor switch, another intermediate conductor plate, and another upper conductor plate equivalent to said semiconductor switch, said intermediate conductor plate, and said upper conductor plate, respectively, are disposed for said third electrode in order to give the another signal potential to said third electrode.

18. The device according to claim 14, wherein said intermediate conductor plate and said upper conductor plate are electrically connected via a connecting conductor embedded in said second insulating layer.

19. The device according to claim 18, wherein said substrate and said intermediate conductor plate are transparent to light selected from the group consisting of visible light and ultraviolet light, said second insulating layer is made of an ultraviolet-curing resin, and said connecting conductor comprises metal pieces dispersed in said second insulating layer.

20. The device according to claim 3, wherein each of said pixels further comprises a bypass resistor in parallel with said first capacitor in order to release electric charge from said first capacitor.

21. The device according to claim 20, wherein said controller applies a gradation display potential different from one pixel to another as the signal potential to perform a gradation display on the basis of an exposure/non-exposure time of said colored portion.

22. The device according to claim 21, wherein said controller divides a one-frame time, which is a display time of an image, into a reset period, writing period, and non-selection period, wherein a reset potential common to all pixels is applied as the signal potential in the reset period, the gradation display potential is applied to a pixel of interest as the signal potential in the writing period, and said internal switch of said pixel of interest is turned off in the non-selection period.

23. The device according to claim 20, wherein said resistor is a variable resistor.

24. A display device comprising:

a pixel matrix defined by rows and columns of a plurality of pixels, each of said pixels comprising a pair of electrodes including first and second electrodes opposing each other, and a colored portion which determines a display color of said pixel by changing an exposed state thereof in accordance with a potential difference between said pair of electrodes;

a plurality of signal lines which run along said pixels to give said first electrode a signal potential as an image signal;

a counter potential line disposed to give a counter potential to said second electrode;

a capacitor so disposed in each of said pixels as to connect a node between said signal line and said first electrode to a constant-potential portion different from said second electrode, in order to hold the signal potential given from said signal line;

a bypass formed in each of said pixels and including a resistor connected to said node in parallel with said capacitor in order to release electric charge from said capacitor;

a signal line driver configured to selectively supply the image signal to said signal lines; and a controller configured to control said signal line driver, said controller applying a gradation display potential different from one pixel to another as the signal potential in order to perform a gradation display on the basis of an exposure/non-exposure time of said colored portion.

25. The device according to claim 24, wherein said controller divides a one-frame time of the image signal into a reset period, writing period, and non-selection period, applies to a pixel of interest a reset potential common to all pixels as the signal potential in the reset period, applies to said pixel of interest the gradation display potential as the signal potential in the writing period, and does not apply the signal potential to said pixel of interest in the non-selection period.

26. The device according to claim 24, further comprising:

a switch so disposed in each of said pixels as to connect said first electrode to said signal line, in order to selectively connect said first electrode to said signal line;

a plurality of address lines which run along said pixels to give said switches an ON/OFF control potential as an address signal for selecting said pixels; and an address line driver controlled by said controller to selectively supply an address signal to said address lines.

27. The device according to claim 24, wherein a resistance value of said resistor is variable.

28. The device according to claim 24, wherein one of said first and second electrodes is a moving film electrode capable of bending, the other one of said first and second electrodes is a counter electrode which opposes said moving film electrode, said colored portion changes an exposed state thereof in accordance with bending of said moving film electrode, and a display color of each pixel is determined when said moving film electrode bends by a potential difference between said moving film electrode and said counter electrode.

* * * * *